US008910606B2

(12) United States Patent
Cleeves et al.

(10) Patent No.: US 8,910,606 B2
(45) Date of Patent: Dec. 16, 2014

(54) POSITIVE CONTROL (DESMODROMIC) VALVE SYSTEMS FOR INTERNAL COMBUSTION ENGINES

(75) Inventors: James M. Cleeves, Redwood City, CA (US); Michael Hawkes, San Francisco, CA (US); William H. Anderson, Cameron Park, CA (US)

(73) Assignee: Pinnacle Engines, Inc., San Carlos, CA (US)

( * ) Notice: Subject to any disclaimer, the term of this patent is extended or adjusted under 35 U.S.C. 154(b) by 226 days.

(21) Appl. No.: 13/269,539

(22) Filed: Oct. 7, 2011

(65) Prior Publication Data

US 2012/0085305 A1 Apr. 12, 2012

Related U.S. Application Data

(60) Provisional application No. 61/498,481, filed on Jun. 17, 2011, provisional application No. 61/511,519, filed on Jul. 25, 2011, provisional application No. 61/391,476, filed on Oct. 8, 2010, provisional application No. 61/391,519, filed on Oct. 8, 2010.

(51) Int. Cl.

| | |
|---|---|
| ***F01L 1/30*** | (2006.01) |
| ***F01L 1/22*** | (2006.01) |
| ***F02B 75/28*** | (2006.01) |
| ***F01L 7/04*** | (2006.01) |
| ***F01L 5/06*** | (2006.01) |
| *F01L 1/18* | (2006.01) |
| *F01L 1/24* | (2006.01) |
| *F01L 1/08* | (2006.01) |

(52) U.S. Cl.

CPC ..... *F01L 5/06* (2013.01); *F01L 2001/186* (2013.01); *F01L 1/181* (2013.01); *F01L 1/2405* (2013.01); *F01L 1/22* (2013.01); *F02B 75/282* (2013.01); *F01L 7/04* (2013.01); *F01L 1/08* (2013.01); *F01L 1/30* (2013.01)

USPC ..... 123/90.24; 123/51 BA

(58) Field of Classification Search

CPC ..... F01L 1/30; F01L 5/06; F01L 7/04; F01L 1/22; F02B 75/282

USPC ..... 123/90.24, 51 BA

See application file for complete search history.

(56) References Cited

U.S. PATENT DOCUMENTS

| | | | |
|---|---|---|---|
| 1,049,123 | A | 12/1912 | Mercer |
| 1,227,812 | A | 5/1917 | Macpherson |

(Continued)

FOREIGN PATENT DOCUMENTS

| | | | |
|---|---|---|---|
| DE | 3926804 | A1 | 2/1991 |
| DE | 19935296 | A1 | 4/2000 |

(Continued)

OTHER PUBLICATIONS

International Search Report and Written Opinion dated Mar. 19, 2012, issued in connection with corresponding PCT Application No. PCT/US2011/055485.

(Continued)

*Primary Examiner* — Zelalem Eshete

(74) *Attorney, Agent, or Firm* — Mintz Levin Cohn Ferris Glovsky and Popeo, P.C.

(57) ABSTRACT

Various types of valve systems are disclosed herein. In one embodiment, a positive control reciprocating sleeve valve system for use with an internal combustion engine includes opening and closing rockers controlled by corresponding opening and closing cam lobes. In one aspect of this embodiment, interference can be designed into the valve control system to provide additional "hold-closed" force to hold the valve against its seat during a portion of the engine cycle. In another aspect of this embodiment, positive control valve systems can include compliant components and systems, hydraulic systems, pneumatic systems, and/or mechanical spring systems to control valve lash, facilitate sealing, etc.

16 Claims, 14 Drawing Sheets

(56) References Cited

U.S. PATENT DOCUMENTS

| | | | |
|---|---|---|---|
| 1,408,781 | A | 3/1922 | Sherman |
| 1,502,291 | A | 7/1924 | Conway |
| 4,538,559 | A | 9/1985 | Imamura et al. |
| 2002/0139335 | A1 | 10/2002 | Palumbo |
| 2008/0115771 | A1 | 5/2008 | Elsbett |

FOREIGN PATENT DOCUMENTS

| | | | |
|---|---|---|---|
| JP | S6149112 | | 3/1986 |
| WO | WO-2012048309 | A1 | 4/2012 |

OTHER PUBLICATIONS

Extended European Search Report dated Mar. 27, 2014 for corresponding European Patent Application No. 11831730.4.

POSITIVE CONTROL (DESMODROMIC) VALVE SYSTEMS FOR INTERNAL COMBUSTION ENGINES

CROSS-REFERENCE TO RELATED PATENT APPLICATIONS INCORPORATED BY REFERENCE

The present application claims priority to and the benefit of U.S. Provisional Patent Application No. 61/511,519, filed Jul. 25, 2011, and entitled "POSITIVE CONTROL (DESMODROMIC) VALVE SYSTEMS FOR INTERNAL COMBUSTION ENGINES;" U.S. Provisional Patent Application No. 61/498,481, filed Jun. 17, 2011, and entitled "POSITIVE CONTROL (DESMODROMIC) VALVE SYSTEMS FOR INTERNAL COMBUSTION ENGINES;" U.S. Provisional Patent Application No. 61/391,476, filed Oct. 8, 2010, and entitled "INTERNAL COMBUSTION ENGINE VALVE ACTUATION AND ADJUSTABLE LIFT AND TIMING;" and U.S. Provisional Patent Application No. 61/391,519, filed Oct. 8, 2010, and entitled "IMPROVED INTERNAL COMBUSTION ENGINE VALVE SEALING;" each of which is incorporated herein in its entirety by reference.

CROSS-REFERENCE TO PATENT APPLICATIONS INCORPORATED BY REFERENCE

U.S. Provisional Patent Application No. 61/391,487, filed Oct. 8, 2010, and entitled "DIRECT INJECTION TECHNIQUES AND TANK ARCHITECTURES FOR INTERNAL COMBUSTION ENGINES USING PRESSURIZED FUELS;" U.S. Provisional Patent Application No. 61/391,502, filed Oct. 8, 2010, and entitled "CONTROL OF COMBUSTION MIXTURES AND VARIABILITY THEREOF WITH ENGINE LOAD;" U.S. Provisional Patent Application No. 61/391,525, filed Oct. 8, 2010, and entitled "SINGLE PISTON SLEEVE VALVE," U.S. Provisional Patent Application No. 61/391,530, filed Oct. 8, 2010, and entitled "CONTROL OF INTERNAL COMBUSTION ENGINE COMBUSTION CONDITIONS AND EXHAUST EMISSIONS;" U.S. Provisional Patent Application No. 61/501,462, filed Jun. 27, 2011, and entitled " SINGLE PISTON SLEEVE VALVE WITH OPTIONAL VARIABLE COMPRESSION RATIO;" U.S. Provisional Patent Application No. 61/501,594, filed Jun. 27, 2011, entitled "ENHANCED EFFICIENCY AND NOX CONTROL BY MULTI-VARIABLE CONTROL OF ENGINE OPERATION;" U.S. Provisional Patent Application No. 61/501,654, filed Jun. 27, 2011, and entitled "HIGH EFFICIENCY INTERNAL COMBUSTION ENGINE;" and U.S. Provisional Patent Application No. 61/501,677, filed Jun. 27, 2011, and entitled "VARIABLE COMPRESSION RATIO SYSTEMS FOR OPPOSED-PISTON AND OTHER INTERNAL COMBUSTION ENGINES, AND RELATED METHODS OF MANUFACTURE AND USE;" are incorporated herein by reference in their entireties.

U.S. Non-provisional patent application Ser. No. 13/270,173, which has issued as U.S. Pat. No. 8,776,739 filed Oct. 11, 2011, and entitled "INTERNAL COMBUSTION ENGINE VALVE ACTUATION AND ADJUSTABLE LIFT AND TIMING;" U.S. Non-provisional patent application Ser. No. 13/270,192, filed Oct. 11, 2011, and entitled "IMPROVED SEALING OF SLEEVE VALVES;" U.S. Non-provisional patent application Ser. No. 12/478,622, which has issued as U.S. Pat. No. 8,365,697, filed Jun. 4, 2009, and entitled "INTERNAL COMBUSTION ENGINE;" U.S. Non-provisional patent application Ser. No. 12/624,276, filed Nov. 23, 2009, and entitled "INTERNAL COMBUSTION ENGINE WITH OPTIMAL BORE-TO-STROKE RATIO," U.S. Non-provisional patent application Ser. No. 12/710,248, which has issued as U.S. Pat. No. 8,573,178, filed Feb. 22, 2010, and entitled "SLEEVE VALVE ASSEMBLY;" U.S. Non-provisional patent application Ser. No. 12/720,457, which has issued as U.S. Pat. No. 8,544,445, filed Mar. 9, 2010, and entitled "MULTI-MODE HIGH EFFICIENCY INTERNAL COMBUSTION ENGINE;" and U.S. Non-provisional patent application Ser. No. 12/860,061, filed Aug. 20, 2010, and entitled "HIGH SWIRL ENGINE;" are also incorporated herein by reference in their entireties.

TECHNICAL FIELD

The present disclosure relates generally to the field of internal combustion engines and, more particularly, to valve systems for use with sleeve valve and other internal combustion engines.

BACKGROUND

There are numerous types of internal combustion engines in use today. Reciprocating piston internal combustion engines are very common in both two- and four-stroke configurations. Such engines can include one or more pistons reciprocating in individual cylinders arranged in a wide variety of different configurations, including "V", in-line, or horizontally-opposed configurations. The pistons are typically coupled to a crankshaft, and draw a charge of fuel/air mixture into the cylinder during a downward stroke and compress the fuel/air mixture during an upward stroke. The fuel/air mixture is ignited near the top of the piston stroke by a spark plug or other means, and the resulting combustion and expansion drives the piston downwardly, thereby transferring chemical energy of the fuel into mechanical work by the crankshaft.

As is well known, conventional reciprocating piston internal combustion engines have a number of limitations—not the least of which is that much of the chemical energy of the fuel is wasted in the forms of heat and friction. As a result, only about 25% of the fuel's energy in a typical car or motorcycle engine is actually converted into shaft work for moving the vehicle, generating electric power for accessories, etc.

Opposing- or opposed-piston internal combustion engines can overcome some of the limitations of conventional reciprocating engines. Such engines typically include pairs of opposing pistons that reciprocate toward and away from each other in a common cylinder to decrease and increase the volume of the combustion chamber formed therebetween. Each piston of a given pair is coupled to a separate crankshaft, with the crankshafts typically coupled together by gears or other systems to provide a common driveline and control engine timing. Each pair of pistons defines a common combustion volume or cylinder, and engines can be composed of many such cylinders, with a crankshaft connected to more that one piston, depending on engine configuration. Such engines are disclosed in, for example, U.S. patent application Ser. No. 12/624,276, which is incorporated herein in its entirety by reference.

In contrast to conventional reciprocating engines which typically use reciprocating poppet valves to transfer fresh fuel and/or air into the combustion chamber and exhaust combustion products from the combustion chamber, some engines, including some opposed piston engines, utilize sleeve valves for this purpose. The sleeve valve typically forms all or a portion of the cylinder wall. In some embodiments, the sleeve valve reciprocates back and forth along its axis to open and close intake and exhaust ports at appropriate times to introduce air or fuel/air mixture into the combustion chamber and exhaust combustion products from the chamber. In other embodiments, the sleeve valve can rotate about its axis to open and close the intake and exhaust ports.

As the foregoing discussion illustrates, both conventional reciprocating piston internal combustion engines and opposed-piston internal combustion engines can utilize some form of reciprocating valve that is opened and closed (generally at half engine speed) to open and close exhaust ports at appropriate times during the engine cycle. Conventional valve actuation systems, such as conventional poppet valve systems, typically rely on a camshaft for valve opening and a spring for valve closure. Yet other systems utilize hydraulic or pneumatic systems for valve actuation. As is known, the term "desmodromic" is commonly used to refer to valve actuation systems in which the valve is positively controlled (i.e., opened and closed) by mechanical means, such as by one or more camshafts controlling both opening and closing rockers. Regardless of what type of valve actuation system an engine uses, opening and closing intake and exhaust valves presents a number of challenges to provide desirable characteristics of timing, lift, duration, sealing, producibility, serviceability, etc.

DETAILED DESCRIPTION

Figure 1:
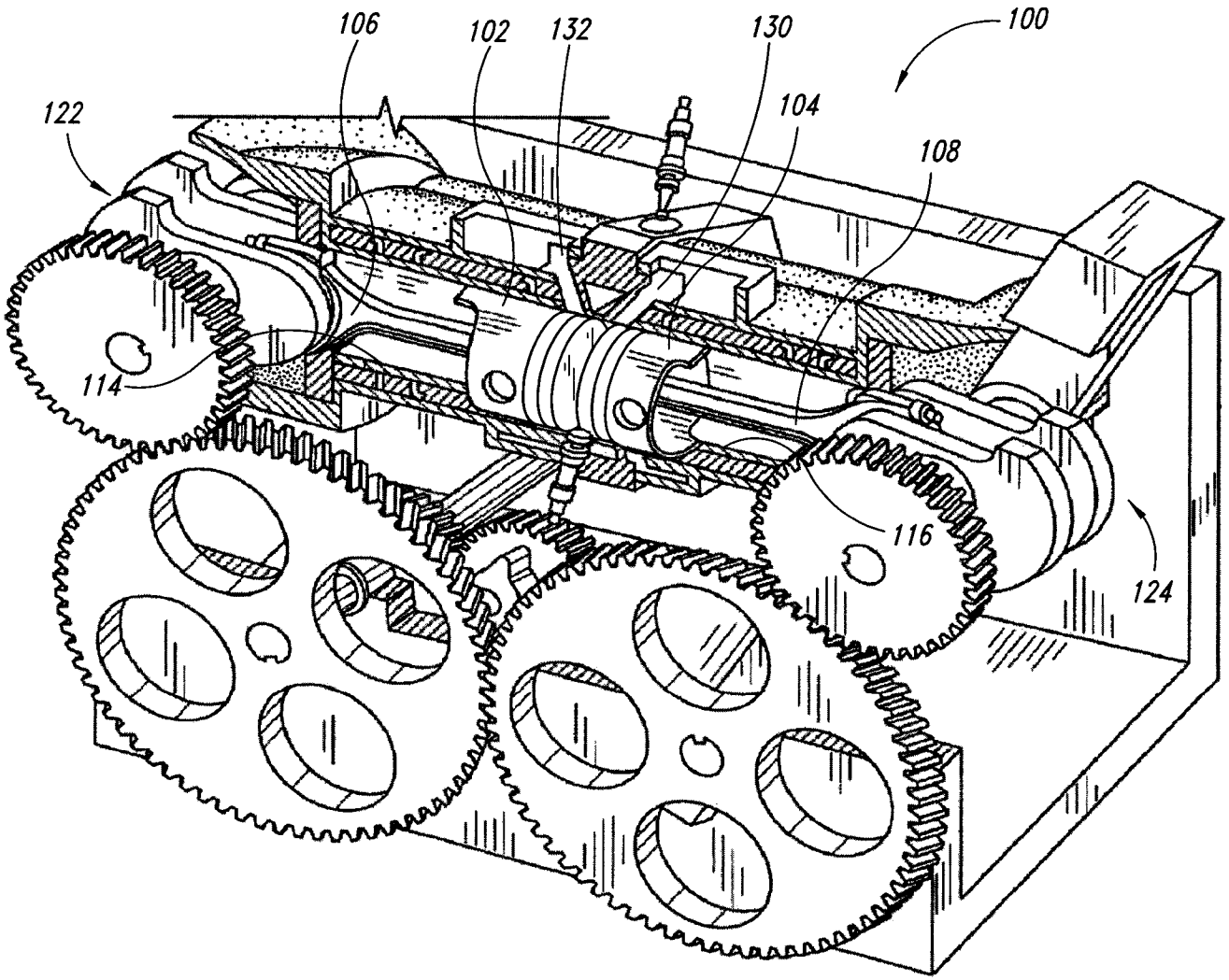
FIG. 1 is a partially cut away isometric view of an internal combustion engine suitable for use with various embodiments of positive control valve systems configured in accordance with the present technology.

The following disclosure describes various embodiments of positive control or "desmodromic" valve actuation systems for use with sleeve valves, poppet valves, and other types of valves which can be used in internal combustion engines (e.g., opposed-piston internal combustion engines), steam engines, pumps, etc. For ease of reference, the term desmodromic may be used in the present disclosure to refer to positive control valve actuation systems. In some embodiments of the present technology, a desmodromic system for actuating a reciprocating sleeve valve in an opposed-piston internal combustion engine includes an opening rocker that drives a first sleeve valve away from its seat to open a corresponding intake passage at an appropriate time in the engine cycle, and a closing rocker that drives the first sleeve valve back toward the seat to close the intake passage at an appropriate time. The system can similarly include another opening rocker that drives a second sleeve valve away from its seat to open a corresponding exhaust passage, and another closing rocker to drive the second sleeve valve back toward the seat to close the exhaust valve. In one aspect of these embodiments, a first camshaft can control operation of the opening and closing rockers associated with the first sleeve valve, while a corresponding second camshaft can control operation of the opening and closing rockers associated with the second sleeve valve.

In another aspect of embodiments of the present technology, the desmodromic valve actuation systems disclosed herein can also include the ability to exert an additional "hold-closed" force on the sleeve valve to hold it firmly against its seat during a portion of the engine cycle (e.g., combustion). This additional "hold-closed" force can help maintain a sufficient gas seal against the combined forces of the internal gas pressure and the piston side loads which tend to tilt the sleeve valve off its seat. Moreover, various embodiments of the positive control valve actuation systems disclosed herein can include compliant components and/or features to facilitate application of this hold-closed force and/or to control valve lash (i.e., the mechanical clearance between the camshaft, rocker and/or valve) in the valve system. In some embodiments, these compliant features can be used in conjunction with hydraulic systems (e.g., a hydraulic lifter) to control lash. In addition, although many embodiments of the present disclosure are directed to positive control valve systems, some embodiments can also include spring systems to facilitate a portion of valve actuation, whether for position control or for hold-closed functionality. These and other details of the present technology are described in greater detail below with reference to the corresponding Figures.

Certain details are set forth in the following description and in FIGS. 1-18 to provide a thorough understanding of various embodiments of the present technology. Other details describing well-known structures and systems often associated with internal combustion engines, opposed-piston engines, etc. have not been set forth in the following disclosure to avoid unnecessarily obscuring the description of the various embodiments of the technology.

Many of the details, relative dimensions, angles and other features shown in the Figures are merely illustrative of particular embodiments of the technology. Accordingly, other embodiments can have other details, dimensions, angles and features without departing from the spirit or scope of the present invention. In addition, those of ordinary skill in the art will appreciate that further embodiments of the invention can be practiced without several of the details described below.

In the Figures, identical reference numbers identify identical, or at least generally similar, elements. To facilitate the discussion of any particular element, the most significant digit or digits of any reference number refers to the Figure in which that element is first introduced. For example, element 110 is first introduced and discussed with reference to FIG. 1.

FIG. 1 is a partially cut away isometric view of an internal combustion engine 100 having a pair of opposing pistons 102 and 104. For ease of reference, the pistons 102, 104 may be referred to herein as a first or left piston 102 and a second or right piston 104. Each of the pistons 102, 104 is operably coupled to a corresponding crankshaft 122, 124, respectively, by a corresponding connecting rod 106, 108, respectively. In the illustrated embodiment, the left crankshaft 122 is operably coupled to the right crankshaft 124 by a series of gears that synchronize or otherwise control piston motion.

In operation, the pistons 102 and 104 reciprocate toward and away from each other in coaxially aligned cylindrical bores formed by corresponding sleeve valves. More specifically, the left piston 102 reciprocates back and forth in a left or exhaust sleeve valve 114, while the right piston 104 reciprocates back and forth in a corresponding right or intake sleeve valve 116. As described in greater detail below, the sleeve valves 114, 116 can also reciprocate back and forth to open and close a corresponding inlet port 130 and a corresponding exhaust port 132, respectively, at appropriate times during the engine cycle.

Figure 2:
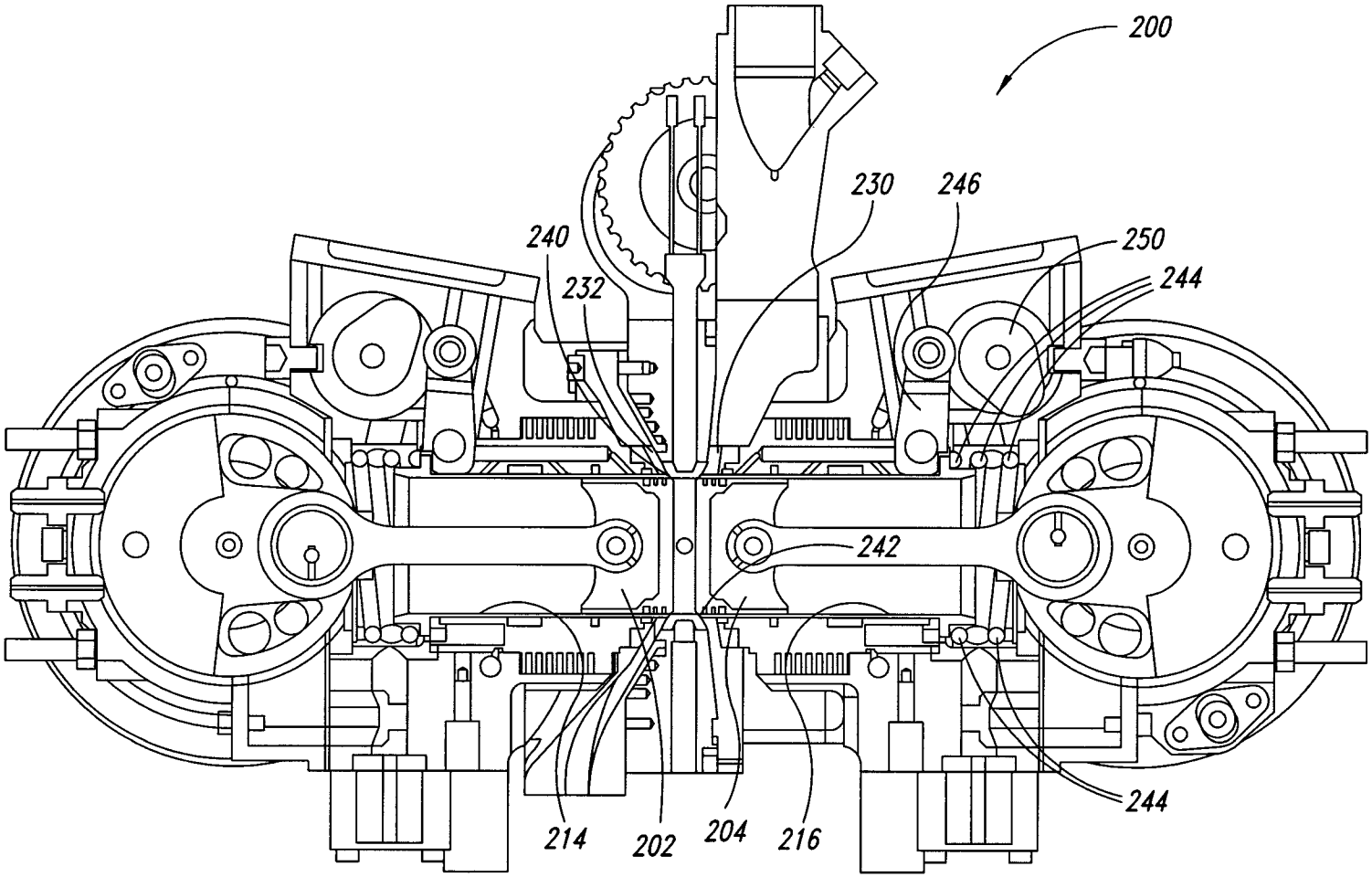
FIG. 2 is a partially cut away front view of an internal combustion engine that is also suitable for use with various embodiments of positive control valve systems configured in accordance with the present technology.

FIG. 2 is a partially cut away front view of an internal combustion engine 200 having a left piston 202 and an opposing right piston 204 which reciprocate back and forth along a common axis as described above with reference to the engine 100 of FIG. 1. The left piston 202 reciprocates in a cylinder defined by an exhaust sleeve valve 214, while the right piston 204 reciprocates back and forth in a cylinder defined by an intake sleeve valve 216. As with the engine 100 described above, the respective sleeve valves 216 and 214 reciprocate back and forth at appropriate times during the piston strokes to open and close a corresponding inlet port 230 and an exhaust port 232, respectively.

In the illustrated embodiment, each of the sleeve valves 214, 216 is opened (i.e., moved away from its corresponding valve seat 240, 242, respectively) by a pivoting rocker arm 246 (or "rocker 246") which has a proximal end portion in operational contact with a corresponding cam lobe 250 and a distal end portion operably coupled to the corresponding sleeve valve. The cam lobe 250 can be carried on a suitable camshaft that, in some embodiments, can be operably coupled the corresponding crankshaft by one or more gears that turn at one-half the crankshaft speed. On the intake side, for example, rotation of the cam lobe 250 drives the proximal end portion of the rocker 246 in one direction (e.g., from right to left), which in turn causes a distal end portion of the rocker 246 to drive the intake sleeve valve 216 in an opposite direction (e.g., from left to right) to thereby open the inlet port 230. In the illustrated embodiment, each of the sleeve valves 214, 216 is closed by a corresponding biasing member, such as a large coil spring 244, that is compressed between a flange on the bottom portion of the sleeve valve and an opposing surface fixed to the crankcase. The biasing member 244 urges the intake sleeve valve 216 from right to left to close the inlet port 230 as controlled by the cam lobe 250.

During operation of either the engine 100 or the engine 200 described above, gas pressure acting directly on at least a portion of the annular leading edges of the sleeve valves 214, 216, as well as piston side loads resulting from the connecting rod angle relative to the cylinder axis, tends to tilt or otherwise lift the sleeve valves 214, 216 off their respective seats 240, 242. The tilting force caused by the rod angle, as well as the lifting force from combustion gas pressure, tends to increase as the cylinder bore diameter increases. If the sleeve valves 214, 216 do not seal sufficiently, however, a number of undesirable consequences can result, including burnt valves, loss of power, poor fuel economy, accelerated wear, etc.

As discussed above with reference to FIG. 2, the engine 200 utilizes large coil springs 244 which act along the centerline of the cylinder to hold the sleeve valves 214, 216 closed. Accordingly, larger bore engines will typically require larger springs to counteract tilting/lifting forces during operation, leading to lower natural frequencies which can limit the operating speed range for a particular engine design. Alternatively, other systems for actuating sleeve valves, such as hydraulic systems, may be relatively costly to implement or may add undesirable complexity to the manufacture and assembly of such engines. As described in greater detail below, the present disclosure describes a number of different embodiments of desmodromic valve systems for positively controlling operation of sleeve valves, poppet valves, and/or other valves in a manner which can address some of these concerns.

Figure 3A:
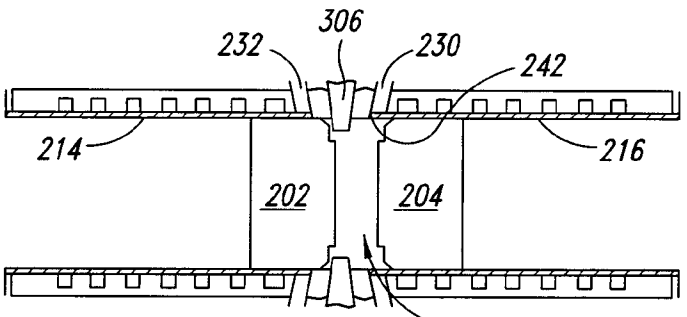
FIGS. 3A-3F are a series of partially schematic, cross-sectional side views illustrating valve timing of an internal combustion engine in accordance with an embodiment of the present technology.
Figure 3B:
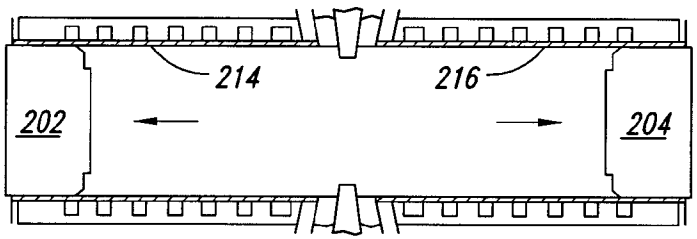
Figure 3C:
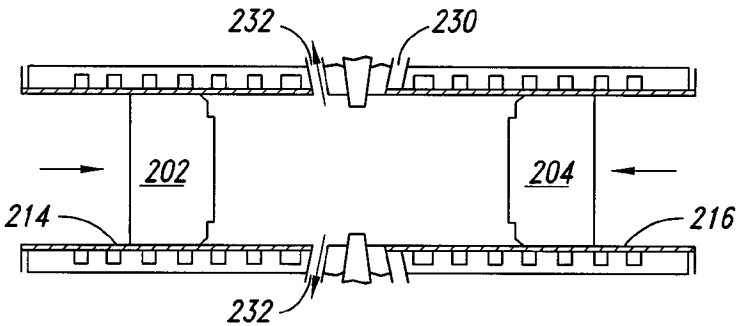

FIGS. 3A-3F are a series of cross sectional side views illustrating operation of the sleeve valves 214, 216 during a representative engine cycle in accordance with an embodiment of the present technology. In FIG. 3A, the left piston 202 and the right piston 204 are shown in a top dead center ("TDC") position during compression of a fuel/air mixture in a combustion chamber 205. Accordingly, both the exhaust sleeve valve 214 and the intake sleeve valve 216 are pressed against their corresponding seats 240 and 242, respectively, to thereby close off both the exhaust port 232 and the inlet port 230 at this time. At or about this time, the compressed fuel/air mixture is ignited by one or more spark plugs 306 or other suitable means. As shown in FIG. 3B, the resulting combustion drives the pistons 202 and 204 outwardly in a power stroke toward their corresponding bottom dead center ("BDC") positions. Both the exhaust valve 214 and the intake valve 216 remain closed during this piston motion. Turning next to FIG. 3C, as the pistons 202 and 204 return back toward the TDC position on the exhaust stroke, the exhaust valve 214 moves from right to left to open the exhaust port 232 and thereby let the combustion products exit the cylinder.

Figure 3D:
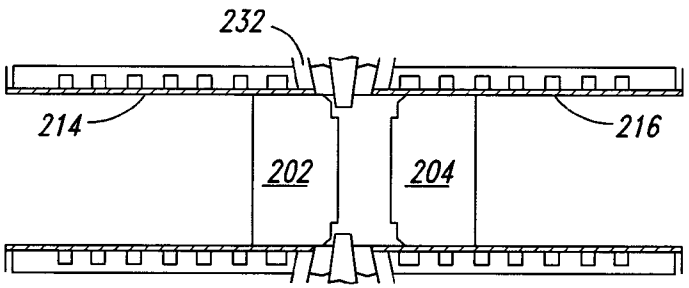
Figure 3E:
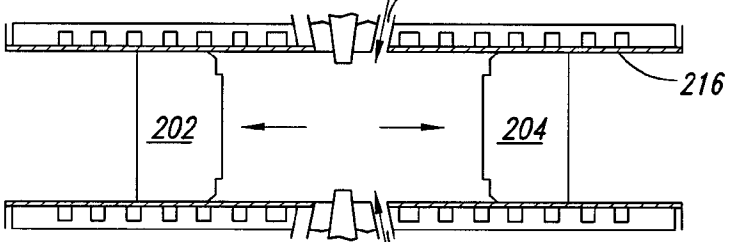
Figure 3F:
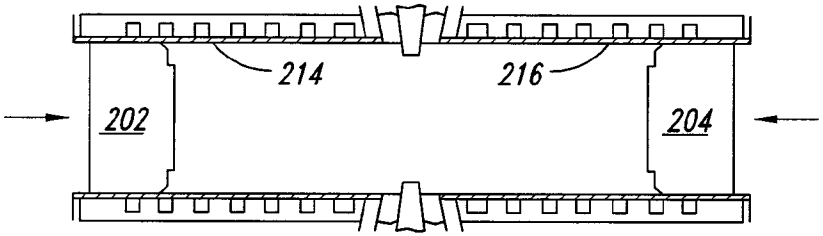

FIG. 3D illustrates the pistons 202 and 204 at the TDC position of the exhaust stroke. At this time, both the exhaust valve 214 and the intake valve 216 are closed. Turning next to FIG. 3E, as the pistons 202 and 204 begin moving outwardly from the TDC position toward the BDC position on the intake stroke, the intake valve 216 moves from left to right to open the inlet port 230 so that a fresh charge of air (or a fuel/air mixture) can flow into the combustion chamber 205. If direct fuel injection is used, for either spark-ignited or diesel cycles, fresh air will flow into the cylinder via the inlet port 230, and subsequently fuel is injected via one or more injectors (not shown). Alternatively, the engine could include a carburetor to introduce fuel/air mixture into the combustion chamber 205 via the inlet port 230 (or via a similar transfer port in a two-stroke configuration). As shown in FIG. 3F, as the pistons 202 and 204 begin the return trip toward the TDC position on the compression stroke, the intake valve 216 moves from right to left and closes the inlet port 230 as the air/fuel mixture is compressed in the cylinder. From this position, the pistons move to the TDC position shown in FIG. 3A and the cycle repeats.

Although the foregoing discussion describes operation of one embodiment of a four stroke opposed-piston/sleeve valve engine for purposes of illustration, those of ordinary skill in the art will appreciate that the systems and methods described herein, and various aspects thereof, are equally applicable to other types of engines (e.g., two stroke engines, diesel engines, etc.) and/or other types of valve systems. Accordingly, the present technology is not limited to a particular engine configuration or cycle. Moreover, the present technology is not limited to internal combustion engines in both two-and four-stroke forms, as it is contemplated that various embodiments and features of the methods and systems disclosed herein can also be used with steam engines, pumps, fuel cells, etc.

Figure 4B:
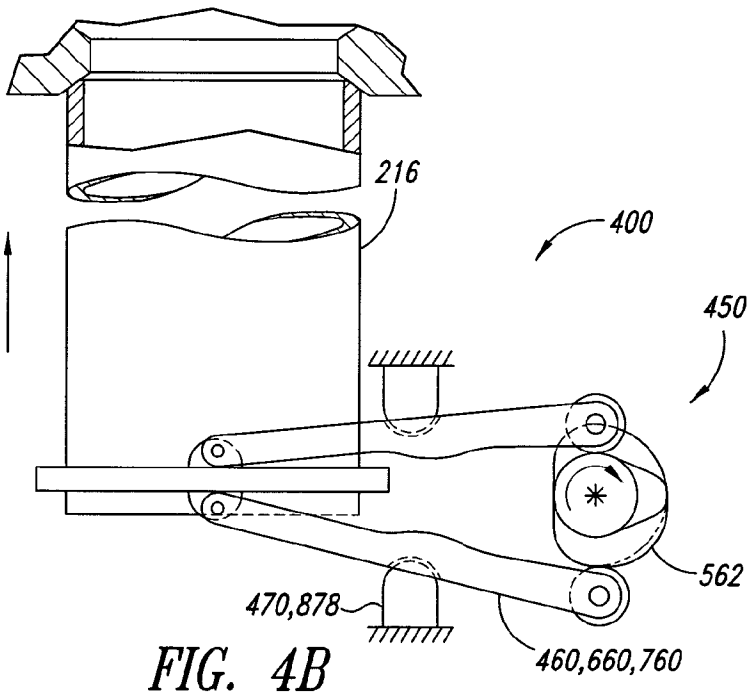
FIGS. 4A and 4B are partially cut away side views of a positive control valve system configured in accordance with an embodiment of the present technology.
Figure 4A:
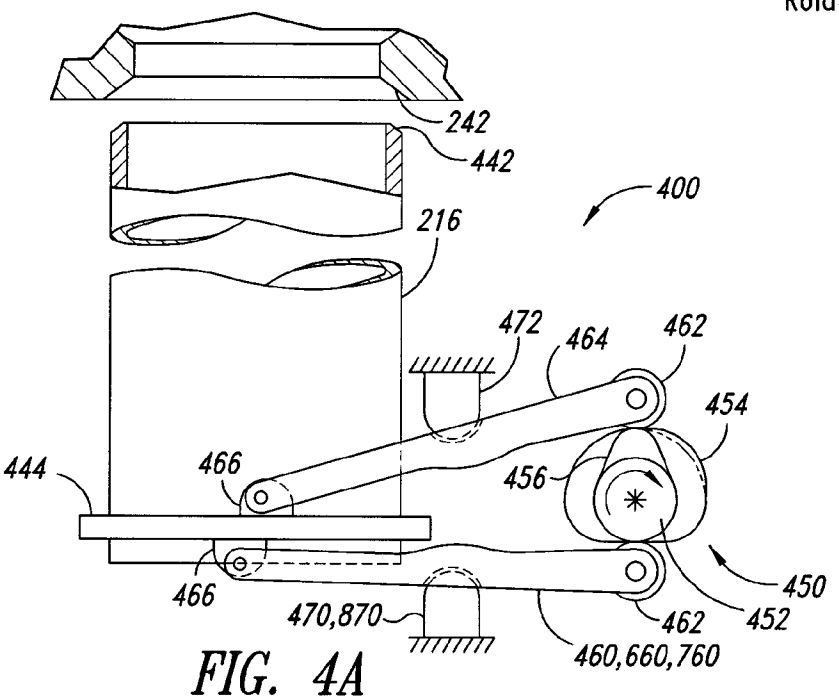

FIGS. 4A and 4B are partially cut away side views of a desmodromic valve actuation system 400 configured in accordance with an embodiment of the present technology. For ease of reference, the desmodromic system 400 is described with reference to the intake sleeve valve 216 from the engine 200 of FIG. 2. The piston 204 and various other components of the engine 200, however, have been omitted from FIGS. 4A and 4B for purposes of clarity. In FIG. 4A, the intake valve 216 is in an open position in which a sealing surface 442 (e.g., an annular beveled surface) has moved away from the valve seat 242 (e.g., a mating annular beveled surface) as would be the case when, for example, the right piston 204 moves toward the BDC position on the intake stroke to draw air or an air/fuel mixture into the combustion chamber 205 through the inlet port 230 (FIGS. 2 and 3E). In FIG. 4B, the intake valve 216 is moved into the closed position in which the sealing surface 442 is pressed against the valve seat 242 as would be the case when, for example, the right piston 204 is at or near the TDC position on either the compression or exhaust stroke.

Referring to FIG. 4A, in the illustrated embodiment the desmodromic valve system 400 includes an opening rocker 464 and a corresponding closing rocker 460. A proximal end portion of each rocker 460, 464 carries a cam follower 462 that rotatably contacts the surface of a corresponding lobe on a camshaft 450. More specifically, the follower 462 of the opening rocker 464 rotates on a surface of an opening cam lobe 456, and the follower 462 of the closing rocker 460 rotates on a surface of a closing cam lobe 454. Although the cam followers reduce operating friction, in other embodiments the cam followers 462 can be omitted and the rockers 460, 464 can include suitable surfaces (e.g., hardened surfaces) on the proximal end portions thereof for slidably contacting the cam lobes 454 and 456. Accordingly, the rockers 460 and 464 can be operably coupled to the cam lobes 454 and 456, respectively, in multiple ways. For example, the rockers 460 and 464 can be operably coupled to the cam lobes 454 and 456 by direct sliding contact between a surface of each rocker 460, 464 and the corresponding cam lobe 454, 456; by rolling contact between a cam follower (e.g., the cam follower 462) and the corresponding cam lobe 454, 456; by indirect contact via, e.g., a pushrod, tappet, spacer, lifter, and/or other mechanical device; etc. The cam lobes 454 and 456 are offset from each other on a central shaft 452 to provide sufficient clearance for the rockers 464 and 460 during operation.

In the illustrated embodiment, the closing rocker 460 operably pivots about a first or closing pivot 470 (e.g., a fulcrum), while the opening rocker 464 operably pivots about a second or opening pivot 472. As described in greater detail below, each of the rocker pivots 470, 472 can include a hemispherical or similarly shaped crown or head portion that is rotatably received a suitably shaped recess on the corresponding rocker to facilitate rocker motion. In other embodiments, however, the rockers 460, 464 can operably pivot about other means, such as a cylindrical pin, shaft, spindle or any type of suitable fulcrum, member or structure.

As described in greater detail below with reference to, for example, FIGS. 6A-7B, each of the rockers 460 and 464 can include two arms that extend in a U-shape manner around the cylindrical sleeve valve 216, and each arm can include a corresponding slider 466 disposed on a distal end portion thereof. In the illustrated embodiment, the sliders 466 slidably bear against opposite sides of an annular flange 444 on the intake valve 216. The sliders 466 can include various types of suitable shapes and materials that are pivotally or otherwise carried on the distal end portions of the corresponding rocker arms.

Accordingly, in the illustrated embodiment the sleeve valve 216 is operably coupled to the camshaft 450 by means of the rockers 460, 464. In other embodiments, however, the sleeve valve 216 can be operably coupled to the camshaft 450 by other means including, for example, by direct sliding contact between the cam lobes 454, 456 and one or more flanges or other features of the sleeve valve 216; by indirect contact between the cam lobes 454 and 456 and the sleeve valve 216 via, e.g., pushrods, cam followers, spacers, tappets and other mechanical devices; etc. Referring to FIGS. 4A and 4B together, rotation of the camshaft 450 (in either direction) provides positive control of the intake valve 216 in both the opening and closing directions. As shown in FIG. 4A, for example, when the opening rocker follower 462 is at the apex or nose of the intake lobe 456 (maximum lift), the closing rocker follower 462 is at the base of the closing lobe 454 and the intake valve 216 is fully open. Conversely, when the closing rocker follower 462 is at or near region of maximum lift of the closing lobe 462, the opening rocker follower 462 is at the base of the intake lobe 456 and the intake valve 216 is fully closed. Throughout this cycle, however, the intake valve flange 444 is constrained between the opposing sliders 216 and valve motion is positively controlled.

As discussed above with reference to, for example, FIG. 2, axial and tilting forces act against the intake valve 216 (as well as the exhaust valve 214) during certain portions of engine operation which tend to lift the valve 216 off its seat 242. Accordingly, it would be desirable to apply additional "hold closed" force to the intake valve 216 (and the exhaust valve 214) during these portions of the engine cycle (e.g., during combustion) to counteract these unseating forces. In one aspect of the present technology, this additional "hold closed" force is provided by an extra "bump" or raised portion added to the profile of the closing lobe 454 of the camshaft 450 that increases the lift beyond what is needed to bring the sealing surface 442 of the valve 216 into contact with the valve seat 242. This feature is discussed in greater detail below with reference to FIG. 5.

Figure 5:
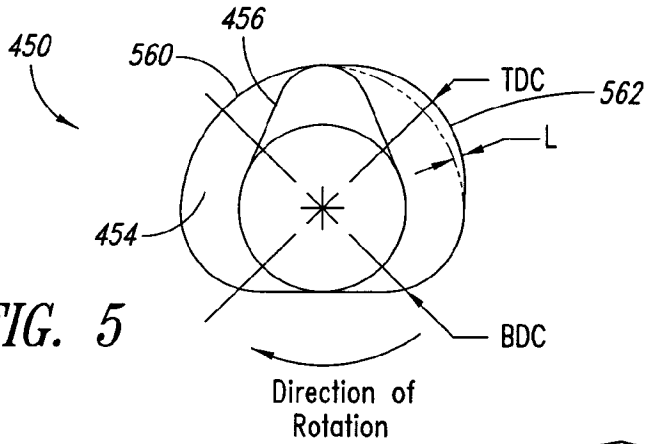
FIG. 5 is an enlarged end view of a positive control camshaft configured in accordance with an embodiment of the present technology.

FIG. 5 is an enlarged end view of the camshaft 450. In the illustrated embodiment, the closing lobe 454 includes a first surface portion 561 spaced apart from a central axis 564 by a first distance and a second surface portion 562 spaced apart from the central axis by a second distance that is greater than the first distance. The dashed line in FIG. 5 represents the theoretical shape (i.e., a circular arc) that the closing lobe 454 would have if it merely held the intake valve 216 closed (i.e., in contact with or in near-contact with the seat 242) with little or no pressure or force throughout the compression and power strokes. As this view illustrates, however, the second surface portion 562 of the closing lobe 454 defines an increased profile that provides additional lift L (e.g., maximum lift) on the closing rocker 460 during a portion of this engine cycle. More specifically, in the illustrated embodiment the second surface portion 562 is approximately centered on the portion of the cam lobe corresponding to TDC on the compression stroke with a suitably smooth transition ramp on either side. The increased lift L causes the closing rocker 460 to exert a greater force on the intake valve 216 in this region, which in turn drives the valve sealing surface 442 against the valve seat 242 with a greater force and pressure to counteract any unseating forces resulting from gas pressure, connecting rod angle, etc. during engine operation. This additional "hold closed" force, however, is not required throughout the cycle. Consequently, the respective valves could be held relatively lightly against their seats when, for example, the opposing valve was being opened. The reduced contact pressure between the closing cam lobe 454 and the corresponding follower 462 during the portions of relatively light pressure can provide an opportunity for an oil film to establish between the moving surfaces, allowing for reduced operating friction, greater wear resistance, and longer service life.

As those of ordinary skill in the art will appreciate, however, increasing the profile or lift of the closing cam lobe 454 as illustrated in FIG. 5 will cause interference between the closing rocker 460 and the cam lobe 454 that will apply greater stress to all the components associated with valve closing. Not only will this additional stress result in higher friction forces, but it could also result in breakage or damage to these components if they are not designed to accommodate these loads. The present technology contemplates a number of different approaches for providing this extra "hold-closed" force on the intake and exhaust valves 216, 214 during a portion of the engine operating cycle (e.g., during combustion) without compromising component life, wear, or engine performance. As described in greater detail below, these approaches include, among other things, using a compliant closing rocker and/or a compliant rocker pivot which deflects at or near the point of peak loads. The term compliant, as used in various places herein, can refer to a support, structure and/or mechanism that deflects or otherwise moves when acted on by a given force, and then quickly or immediately returns to its initial form or state as the force is reduced. Such features can include elastic elements (e.g., compressible springs, rubber, etc.), flexible elements, resilient elements, etc.

Figure 6B:
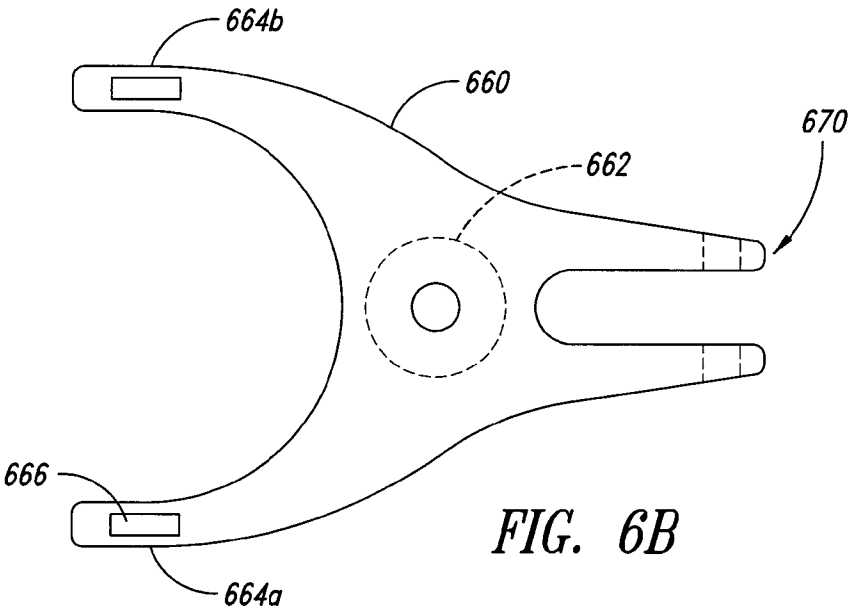
FIG. 6A-6C are side, top and isometric views, respectively, of a sleeve valve rocker configured in accordance with an embodiment of the present technology.
Figure 6A:
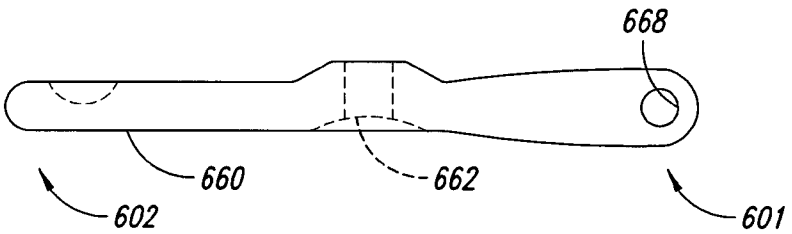
Figure 6C:
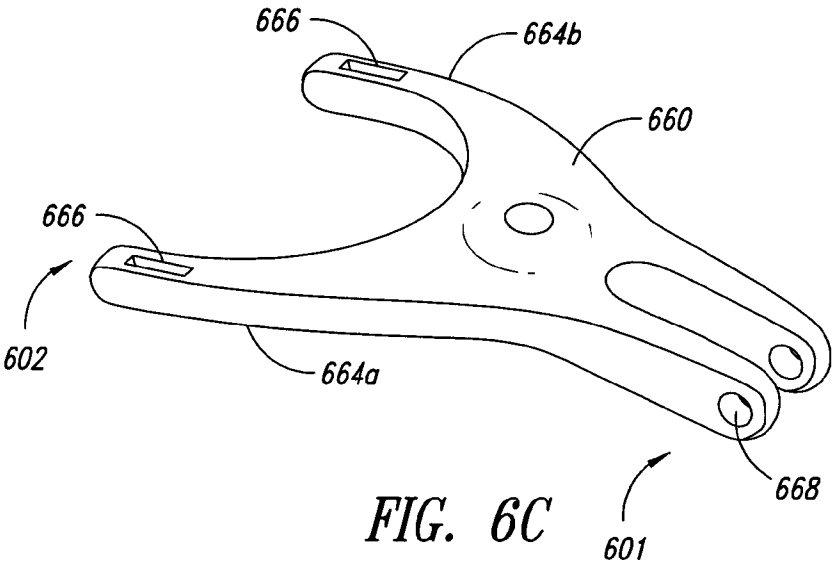

FIGS. 6A-6C are a series of side, top and isometric views, respectively, of a compliant closing rocker 660 configured in accordance with an embodiment of the present technology. Referring to FIGS. 6A-6C together, the compliant rocker 660 includes a proximal end portion 601 spaced apart from a distal end portion 602. The proximal end portion 601 can include a clevis portion 670 having opposing bores 668 configured to receive a pin to rotatably support the cam follower 462 (FIGS. 4A and 4B) therebetween. The distal end portion 602 can include a first arm 664*a* configured to extend around one side of the sleeve valve, and a corresponding second arm 664*b* configured to extend around the opposite side of the sleeve valve. Moreover, the distal end portion of each arm 664 can include a recess 666 or similar feature configured to moveably retain the slider 466 or other device for slidably contacting the flange 444 (FIG. 4A, B) on the sleeve valve. The compliant closing rocker 660 can further include an engagement feature 662, such as a hemispherical-shaped recess, configured to pivotally receive the crown of the rocker pivot 470 (FIG. 4A, B) to operably couple the rocker 660 to the rocker pivot 470. The closing rocker 660 can be manufactured from a plurality of suitable materials using a plurality of suitable methods known in the art. Such materials can include, for example, various metals such as forged, low alloy, medium carbon steels or high carbon steels with high yield strengths.

In one aspect of the illustrated embodiment, the arms 664 and/or other portions of the closing rocker 660 can be shaped and sized or otherwise designed to provide a desired amount of additional "hold-closed" force by virtue of the increased lift L of the closing cam lobe 454 (FIGS. 4 and 5). For example, the rocker stiffness can be designed to provide sufficient flex at peak cam interference to hold the intake valve 216 closed against the seat 242 with sufficient force, but without experiencing permanent deformation, damage or unacceptable levels of friction in the components of the valve system. In one embodiment, this can be achieved by making the rocker 660 from a suitable material (e.g., spring steel) with a stiffness that would provide a maximum stress level well below the fatigue limit of the material.

Figure 7A:
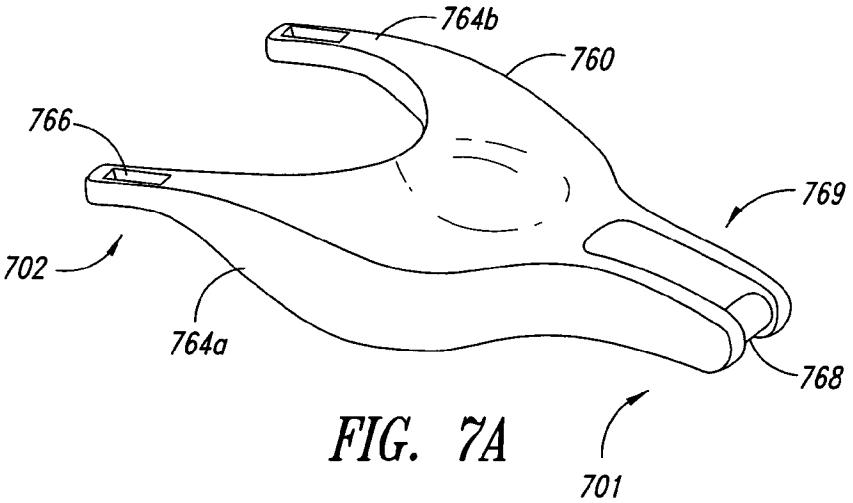
FIGS. 7A and 7B are top and bottom isometric views, respectively, of a sleeve valve rocker configured in accordance with another embodiment of the present technology.
Figure 7B:
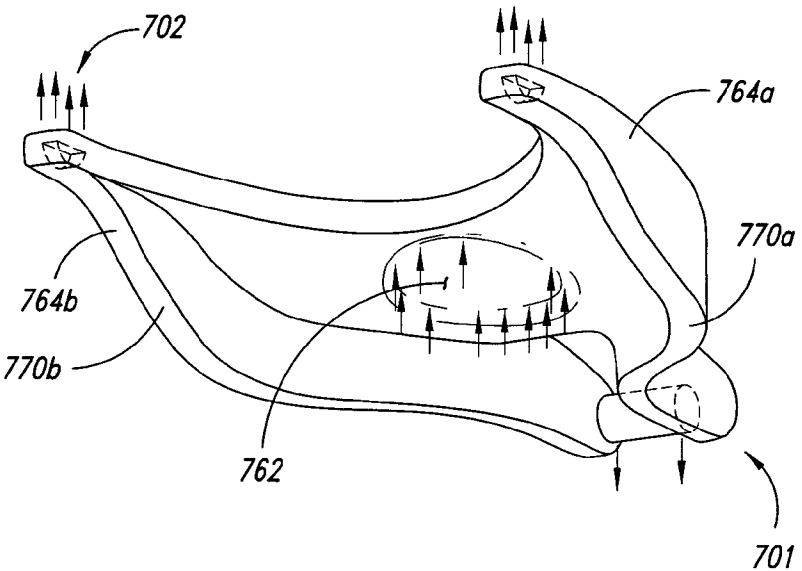

FIGS. 7A and 7B are top and bottom isometric views, respectively, of a closing rocker 760 configured in accordance with another embodiment of the present technology. As described below with reference to FIG. 8, unlike the closing rocker 660 described above, the closing rocker 760 is not designed to flex or deflect appreciably, but instead is designed to be relatively stiff. Accordingly, in this embodiment the interference caused by the additional hold-closed lift L of the closing lobe 454 is absorbed and reacted by a compliant rocker pivot.

Referring to FIG. 7A and 7B together, many aspects of the closing rocker 760 are at least generally similar in structure and function to the closing rocker 660 described in detail above. For example, the rocker 760 can include a first or proximal end portion 701 having a clevis portion 769 with a corresponding shaft 768 configured to carry the cam follower 462 (FIGS. 4A and 4B). Moreover, the closing rocker 760 can also include a second or distal end portion 702 having first and second arms 764*a, b* which extend around opposite sides of the sleeve valve, and the arms 764 can include recesses 766 (e.g., cylindrical recesses) and/or other suitable features (e.g., axel pins) to pivotally support the sliders 466. As shown to good effect in FIG. 7B, however, in this embodiment each of the rocker arms 764 includes a corresponding flange 770 shaped and sized to provide ample stiffness to the closing rocker 762 to reduce or minimize unwanted deflection during operation. As this view also shows, the underside of the closing locker 760 can include a hemispherical or similarly shaped recess 762 configured to receive the crown of the corresponding rocker pivot.

Figure 8:
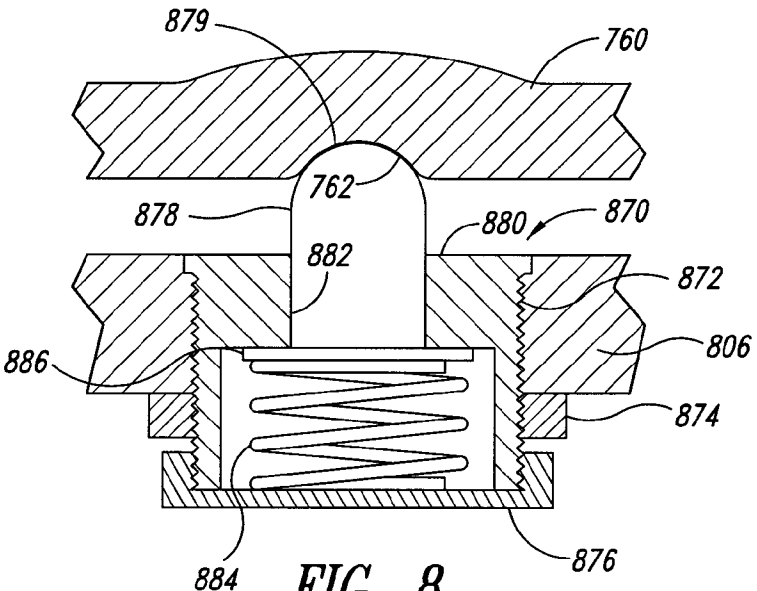
FIG. 8 is a cross-sectional side view of a compliant rocker pivot configured in accordance with an embodiment of the present technology.

FIG. 8 is a partial cross-sectional side view of a compliant rocker pivot assembly 870 configured in accordance with an embodiment of the present technology. In the illustrated embodiment, the pivot assembly 870 includes a generally cylindrical body or housing 880 having a plurality of external threads 872 for installing the pivot assembly 870 in a portion of the crankcase or other suitable mounting structure 806 (e.g., a portion of the crankcase adjacent the corresponding sleeve valve). The threads 872 can also accept a hex nut 874 or other locking device to retain the pivot assembly 870 in position during use. In other embodiments, other engagement features, such as snap rings, etc. can be used to retain the pivot assembly 870 in the desired position.

In the illustrated embodiment, the pivot assembly 870 includes a cylindrical support member 878 slidably received in a bore 882 in the housing 880. One or more biasing members 884 (e.g., a compressed coil spring, a stack of Belleville washers, etc.) is compressed between a flange 886 at the base of the support member 878 and an opposing cap 876 threadably or otherwise engaged with the housing 880. In the illustrated embodiment, the support member 878 includes a hemispherical head or crown portion 879 that is pivotally received in the recess 762 formed in the closing rocker 760. In other embodiments, the support member 878 can include other features for rotatably or pivotally engaging the closing rocker 760. Such other features can include, for example, pivot shafts, spherical bearings, etc.

Adjustment of the position of the housing 880 relative to the mounting structure 806 can control the clearance or lash in the closing rocker system at times other than the "hold closed" location (e.g., times when the closing rocker is under relatively low or no load). Allowing clearance at these times allows oil films to reform on various sliding surfaces to enable long wear life, as discussed below. In one embodiment, for example, the one more biasing members 884 and associated features can be replaced by a suitable hydraulic lash unit. Utilizing a hydraulic lash adjustment system could potentially reduce component and assembly cost. By way of example, such a hydraulic system could include a check valve that enables fluid to flow into a cylinder behind the pivot member 878 and not escape when needed to reduce lash (e.g., during valve deceleration, valve reacceleration, and hold-closed). Conversely, the check valve can be controlled to reduce pressure and allow slight valve/cam clearance when the associated cam is under essentially no load. For example, the system can be configured to provide slight clearance between the closing rocker and the closing cam lobe during the exhaust stroke and/or during the valve opening acceleration. Although the above discussion addresses use of a hydraulic system with a compliant pivot system, in other embodiments similar hydraulic systems can be employed with compliant rocker systems as well, with differing available times for filling the hydraulic cylinder, Moreover, in yet other embodiments similar pneumatic systems can be employed to favorably control valve lash throughout the engine cycle.

Referring to FIGS. 4A, 4B and 8 together, in operation the closing rocker 760 pivots back and forth on the pivot member 878 in response to rotation of the closing cam lobe 454. When the cam lobe 454 reaches the position shown in FIG. 4B, the valve 216 is fully closed and the subsequent interference resulting from the increased lift L (FIG. 5) increases the bending load on the closing rocker 760. The biasing member 884 reacts this load by urging the pivot member flange 886 against the housing 880 until the closing lobe 454 applies sufficient hold-closed force to overcome the preload in the biasing member 884. When this happens, the compression force on the pivot member 878 causes the flange 886 to lift off its seat and further compress the biasing member 884. However, the additional hold-closed force provided by the increased cam lift L and the compressed biasing member 884 is sufficient to prevent the intake valve 216 from unseating during the period of high unseating loads. Although the foregoing discussion is presented in the context of the intake valve 216 for purposes of illustration, those of ordinary skill in the art will no doubt appreciate that various embodiments and aspects of the systems and methods described herein are equally applicable to use with exhaust valves, such as the exhaust valve 214. Accordingly, the present disclosure is not limited to any particular valve, engine, or pump configuration, but extends to any such system having similar parts with similar performance requirements.

Conventional desmodromic valve actuation systems are known for having low friction at low engine speeds and relatively high friction at high engine speeds. This attribute may be due in large part to the use of sliding contact surfaces between the cam lobes and the rockers. Moreover, roller cam followers are not typically used in conventional desmodromic systems. In various embodiments of the present technology, however, the desmodromic valve actuation systems disclosed herein have the potential to induce relatively high friction at all engine speeds due to the relatively high "hold-closed" forces applied to the valves at all engine speeds. Accordingly, a roller cam follower, such as the cam follower 462 described above, may be desirable in such embodiments, at least on the closing rocker. Moreover, as describe in greater detail below with reference to, for example, FIG. 16, the additional mass of the cam followers move in the opposite direction of the valve during engine operation and can therefore counterbalance the inertial loads introduced by the valve and thereby reduce overall engine vibration.

Figure 9A:
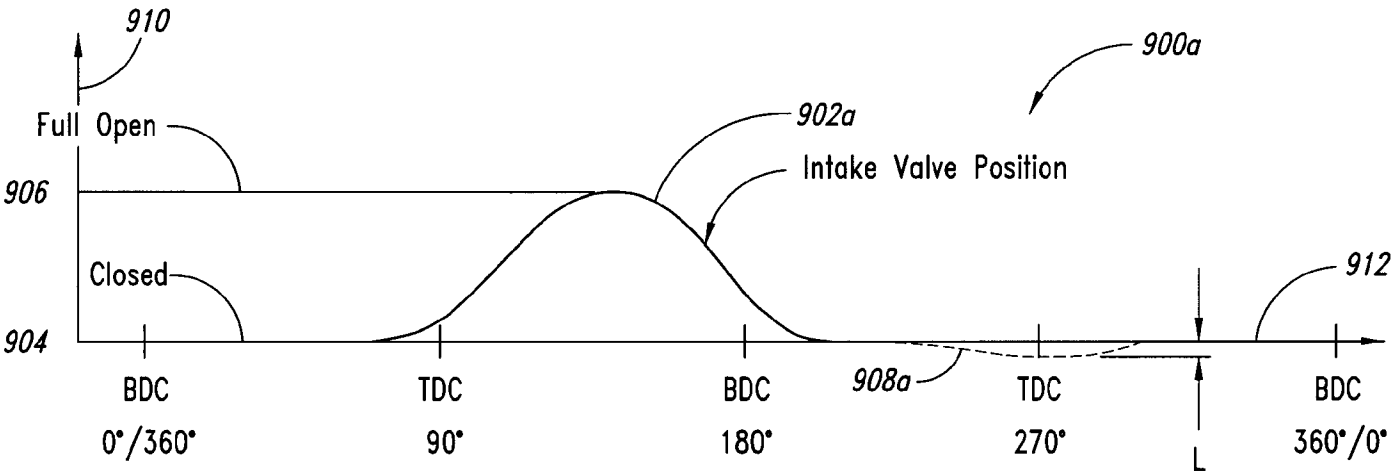
FIGS. 9A and 9B are graphs illustrating intake valve lift versus piston timing in accordance with two embodiments of the present technology.
Figure 9B:
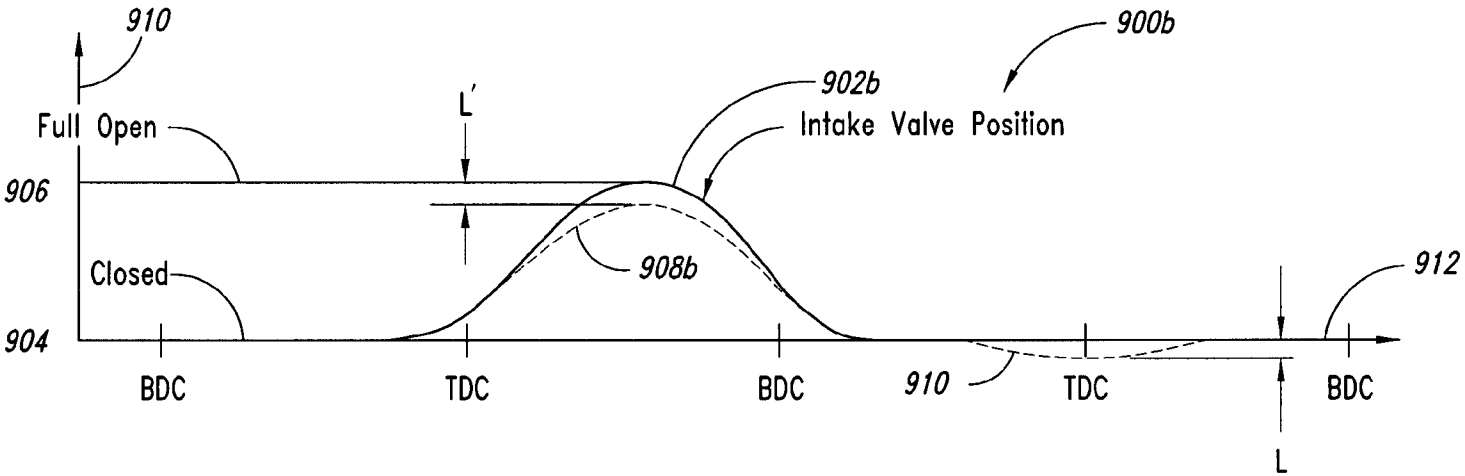

FIGS. 9A and 9B illustrate first and second graphs 900A and 900B, respectively, of intake valve lift versus crankshaft/piston timing in accordance with two embodiments of the present technology. Referring first to FIG. 9A, valve lift is measured along a vertical axis 910 and crankshaft timing is measured along a horizontal axis 912. In one aspect of this embodiment, the first graph 900A includes a first plot line 902*a* illustrating intake valve position for a desmodromic valve system utilizing a compliant closing rocker pivot, such as the compliant rocker pivot 878 described above with reference to FIG. 8, and a cam lobe with additional "hold-closed" lift, such as the closing lobe 454 shown in FIG. 5. As the plot line 902*a* shows, the intake valve (e.g., the intake valve 216) begins opening before TDC on the intake stroke, and then ramps up to a full open position 906 about midway down on the intake stroke, before ramping down to closure just after BDC. Accordingly, as the intake valve approaches a fully closed position near TDC on the compression stroke (270°), the compliant rocker pivot is lifted off of its seat and the "hold-closed" lift on the closing cam lobe drives the valve more firmly against the corresponding valve seat by virtue of the compression force exerted on the closing rocker by the compliant rocker pivot. This additional "hold-closed" lift L is illustrated by a dashed plot line 908*a*.

Referring next to FIG. 9B, in one aspect of this embodiment the second graph 900B includes a second plot line 902*b* illustrating intake valve position for a desmodromic valve system utilizing a compliant closing rocker, such as the compliant closing rocker 660 described above with reference to FIG. 6A-6C. In another aspect of this embodiment, an interference lift L' can be designed into the opening cam lobe and/or the closing cam lobe at the full open position 906 to account for deflection of the closing rocker that occurs at the fully open position 906 at high engine speeds. This interference lift L' is shown by a dashed plot line 908*b* which illustrates what the intake valve position would be if controlled exclusively by the closing cam lobe profile. Accordingly, the relationship between the dashed line 908*b* and the solid line 902*b* illustrates that the inertia of the intake valve moving toward the full open position 906 in combination with the force exerted by the stiffer opening rocker causes the closing rocker to deflect in proportion to the interference lift L' that exists between the opening cam lobe an the closing cam lobe at the full open position 906. Thus, the interference lift L' prevents gapping between the opening rocker and the opening cam lobe as a result of deflection of the compliant closing rocker caused by valve inertia at the fully open position 906. As shown by a dashed plot line 910, however, when the valve approaches the fully closed position around TDC on the compression stroke, the hold-closed lift L is again absorbed by deflection of the compliant closing rocker which in turn exerts the additional hold-closed force against the intake valve seat to counteract any unseating forces.

As those of ordinary skill in the art will appreciate, at relatively low engine speeds in the compliant rocker embodiment discussed above, there will be interference between the opening and closing rockers between the TDC and BDC positions on the intake stroke. Although this will add friction to the system, the spring energy stored in the closing rocker is returned to the system as the valve transitions from acceleration on the closing motion to deceleration of the closing motion. As explained above with reference to FIG. 9B, however, this same interference can be designed out of the system as the engine approaches top design speed by designing the closing rocker to deflect under the inertial loads imposed by the valve at the fully open position in an amount that is roughly equivalent to the interference caused by the interference lift L'. In the foregoing manner, the closing cam lobe can control the valve to follow the opening cam lobe profile without significant interference or gapping between the opening rocker and the opening cam lobe.

As noted above, much of the energy stored in either the compliant rocker system or the compliant rocker pivot system will get returned to the valve control system, minus friction. As further illustrated by reference to the plot lines on the second graph 900B in the regions of TDC on the exhaust stroke and BDC on the intake stroke, during valve opening acceleration as well as valve closing deceleration there is no need to have any interference between the opening and closing rockers. Accordingly, the operating friction away from the regions of interference can be significantly reduced and provide an opportunity for oil to be replenished on the valve/cam lobe contact surfaces.

As mentioned above with respect to, for example, the compliant rocker 660 of FIG. 6A-6C, the closing rocker lobe can be designed with an extra "hold-closed" lift that tries to push the valve past the valve seat. The increased force on the valve resulting from the increased lift in the closing cam lobe will be a function of the stiffness of, among other elements, the closing rocker. To address this, the closing rocker can be designed with enough flex to provide the desired closing force to obtain a sufficient seal of the valve, but not enough force to damage any of the parts in the valve system.

By way of example, suppose that in one embodiment it is desirable to provide 1500 newtons of hold-closed force on the valve to provide sufficient sealing. One way to do this might be to design a closing rocker that provides about 100 newtons of force per 0.01 mm of deflection. Such a system would then require 0.15 mm (approximately 0.006 inch) of interference between the closing rocker, cam lobe and valve seat to provide the desired 1500 newtons of hold-closed force. Providing such a small interference, however, would require that the physical relationship between the closing cam, the rocker, the valve and valve seat be known to within +/− a few 0.01 mm's. This would require significant control of machining and assembly tolerances, as well as temperature control of all the elements.

However, if the rocker is designed to provide 100 newtons of force per 0.1 mm of deflection, then 1.5 mm of deflection would be required to provide the desired 1500 newtons of extra closing force. In this situation, a variation in manufacturing tolerances of +/−0.1 mm would only yield a +/−100 newtons variation of the desired 1500 newtons sealing force. Moreover, closing rockers could be manufactured to within 0.1 mm tolerance fairly easily using conventional manufacturing technology, even with the additional tolerances caused by thermal variations in operating environments.

Continuing with the foregoing example, however, at high engine speeds the forces on the closing rocker system could approach 500 newtons or more as the closing rocker slows and then stops the opening valve. This load could cause the closing rocker system to deflect about 0.5 mm as it reverses the direction of the valve. This extra 0.5 mm would provide a corresponding 0.5 mm gap between the opening rocker system and the closing system as the valve approaches the fully open position at high engine speed. This gap could result in relatively large impact loads as the gap is taken up during the closing deceleration portion of the valve travel. As explained above with reference to FIG. 9B, however, the additional gap caused by the inertia of the valve can be addressed by designing the deflection into the cam lobe profile(s). More specifically, at low engine speed where the inertial forces from the valve are relatively low, an interference would be designed into the open and closing rocker systems by virtue of the corresponding cam lobe shapes to provide a 500 newtons force during the valve opening deceleration and reacceleration periods. At higher engine speeds, however, this interference vanishes as the inertial loads in the valve cause the closing rocker system to deflect a distance equal to or at least approximately equal to the interference. As a result, there is little or no interference load on the rocker system at high engine speeds. A similar arrangement can also be employed with the compliant rocker pivot system described above. More specifically, the compliant rocker pivot assembly 870 can be designed to deflect under the hold-closed force but not (appreciably) under the inertia of valve deceleration at high engine speeds.

Figure 10B:
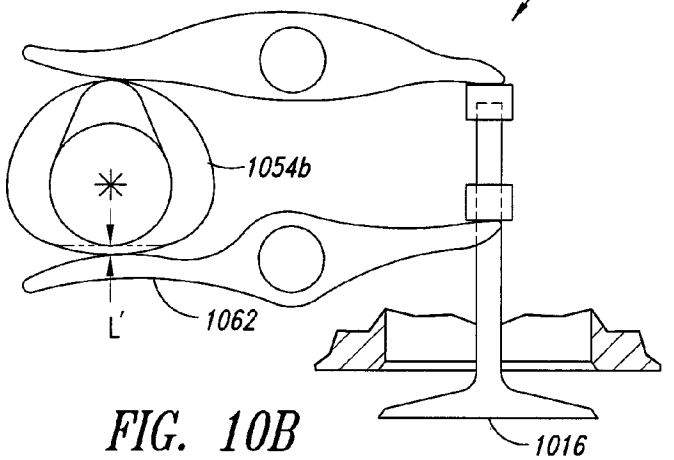
FIGS. 10A and 10B are side views of positive control poppet valve actuation systems utilizing aspects of the present technology.
Figure 10A:
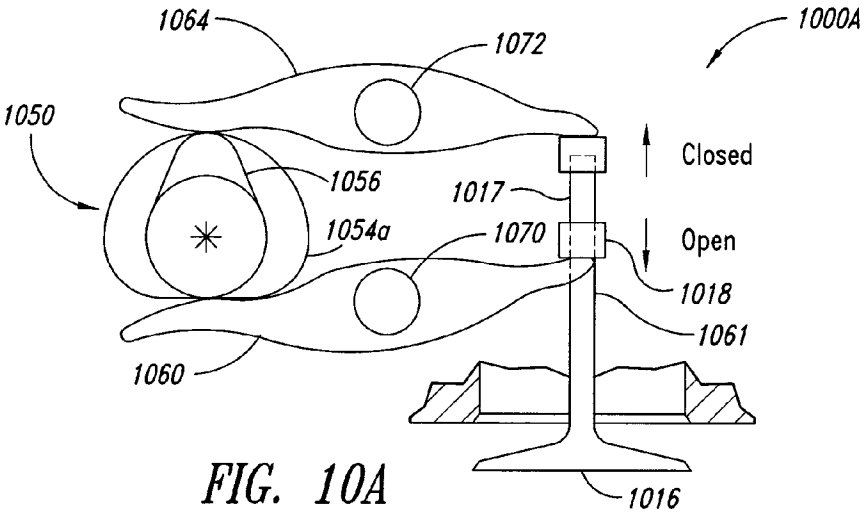

Although the foregoing discussion of the various positive control (i.e., desmodromic) valve actuation systems of the present technology have been discussed in the context of sleeve valves for use with opposed-piston engines, the features and principals of the systems described above can also be employed with other types of positive control valve systems. FIGS. 10A and 10B, for example, are side views of desmodromic valve actuation systems for use with poppet valves in accordance with embodiments of the present technology.

FIG. 10A illustrates a conventional desmodromic valve system 1000A in which an opening rocker 1064 and a closing rocker 1060 pivot about an opening spindle 1072 and a closing spindle 1070, respectively. A camshaft 1050 includes an opening lobe 1056 and a closing lobe 1054*a*. Rotation of the opening lobe 1056 causes a distal end portion of the opening rocker 1064 to push down on a stem 1017 of a poppet valve 1016 to open the valve 1016 in a conventional manner. Conversely, rotation of the closing lobe 1054*a* causes a forked end portion 1061 of the closing rocker 1060 to engage a collar 1018 on the poppet valve 1016 and drive the poppet valve 1016 back upwardly toward a closed position. In conventional desmodromic systems, the cam lobes, rockers, and valve stem engagement features must be manufactured and assembled with precision to maintain the very close tolerances required for proper valve sealing without interference which could potentially lead to excessive drag, wear, and even breakage of the components in the valve system.

FIG. 10B illustrates a desmodromic poppet valve system 1000B having a compliant closing rocker 1062 configured in accordance with an embodiment of the present technology. In contrast to the system illustrated in FIG. 10A, the system of FIG. 10B includes a closing cam lobe 1054*b* with an increased profile portion or increased lift L' that results in interference between the opening and closing rocker systems during engine operation. In one aspect of this embodiment, however, the rocker 1062 is a compliant rocker that can undergo this deflection at all engine speeds without sustaining damage or undesirable wear. In one aspect of this embodiment, the compliant closing rocker 1062 enables the valve system components to be manufactured and assembled to relatively looser tolerances than conventional desmodromic systems, and still provides more than ample closing force on the poppet valve 1016. Moreover, it will be appreciated that although the compliant rocker 1062 is designed to deflect and absorb the interference between the opening and closing cam lobes, the compliant rocker 1062 is nevertheless stiff enough to prevent undesirable deflection in response to the inertial loads on the poppet valve 1016 at high engine speeds.

Figure 11B:
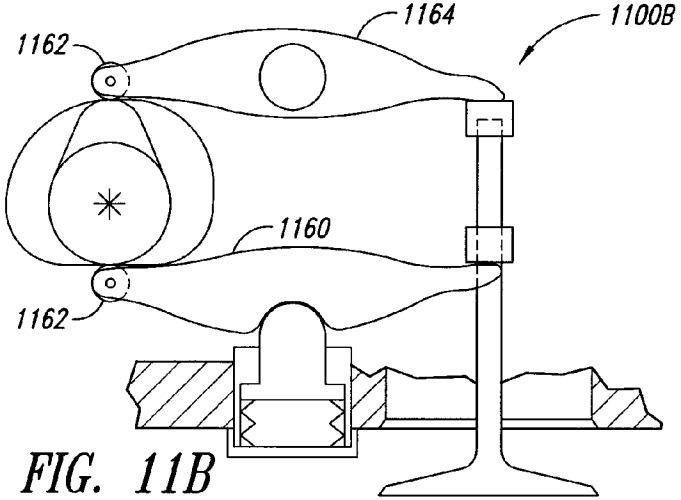
FIGS. 11A and 11B are side views of positive control poppet valve actuation systems utilizing further aspects of the present technology.
Figure 11A:
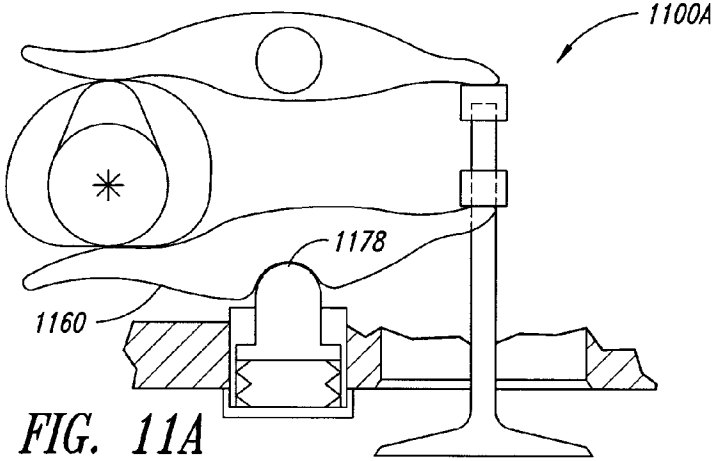

FIGS. 11A and 11B are side views of desmodromic poppet valve systems 1100A and 1100B, respectively, having compliant rocker pivots configured in accordance with embodiments of the present technology. Many features and components of the desmodromic systems 1100A and 1100B can be at least generally similar in structure and function to the corresponding components described above with reference to FIG. 10A. In the illustrated embodiment, however, the valve system 1100A includes a closing rocker 1160 configured to operably pivot on a compliant rocker pivot 1178. The compliant rocker pivot 1178 can be at least generally similar in structure and function to the compliant pivot assembly 870 described above with reference to FIG. 8. Accordingly, the compliant rocker pivot 1178 can reduce the manufacturing and assembly precision required for the desmodromic system 1100A without introducing excessive wear or loads on the system components.

It should be noted that, unlike the sleeve valve systems described above, the additional interference L' of the closing cam lobe 1054*b* of FIG. 10B, as well as the additional compression force provided by the compliant rocker pivot 1178, are not provided in the corresponding desmodromic poppet valve systems to facilitate valve seating, because the internal gas pressure in conventional reciprocating piston engines facilitates valve seating. Rather, the compliant rocker components described above are provided to enable the corresponding poppet valve systems to be constructed and assembled with lower manufacturing tolerances and hence lower cost and greater service life.

Turning next to FIG. 11B, the desmodromic poppet valve actuation system 1100B is generally similar in structure and function to the valve actuation system 1100A described above with reference to FIG. 11A. In the illustrated embodiment, however, the proximal end portions of a closing rocker 1160*a* and an opening rocker 1164 carry roller cam followers 1162 to further reduce friction in the system. Such followers can be used on either the compliant rocker systems described herein as well as the compliant rocker pivot systems described herein to reduce friction.

Figure 12A:
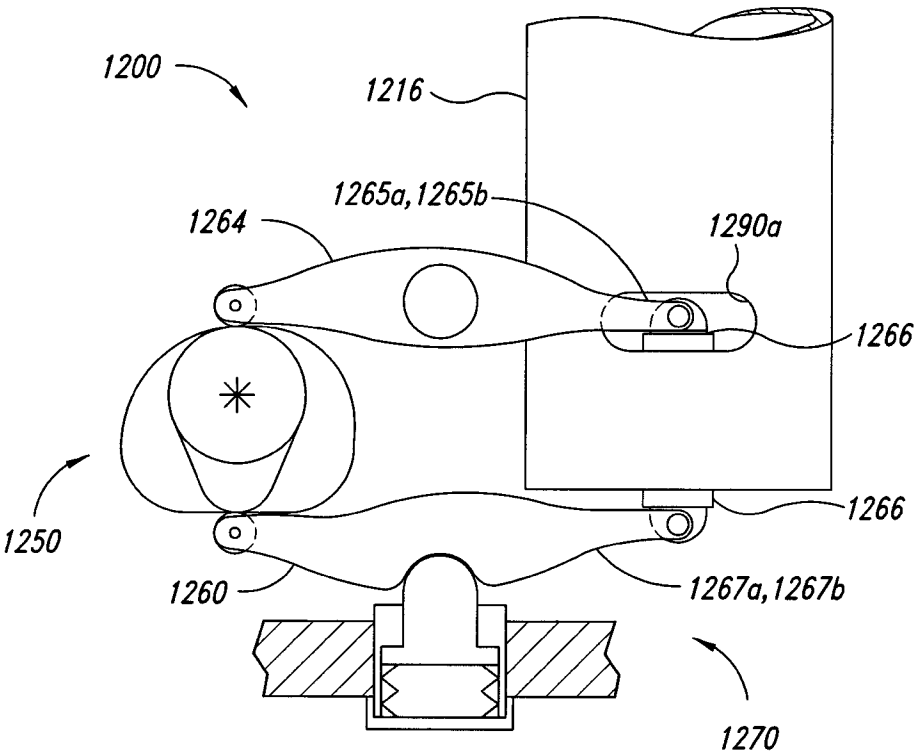
FIGS. 12A and 12B are side and bottom end views, respectively, of a positive control sleeve valve actuation system configured in accordance with yet another embodiment of the present technology.
Figure 12B:
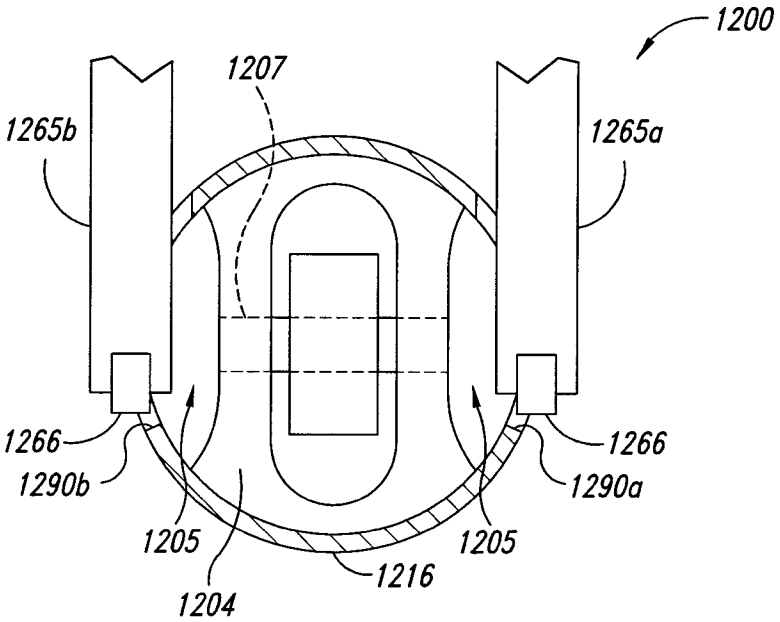

FIGS. 12A and 12B are side and partially cross-sectional bottom end views, respectively, of a desmodromic sleeve valve actuation system configured in accordance with yet another embodiment of the present technology. Many components and features of the valve actuation system 1200 are at least generally similar in structure and function to corresponding components and features of the valve actuation system 400 described above with reference to FIGS. 4A and 4B. For example, the system 1200 includes a camshaft 1250 that controls motion of an opening rocker 1260 and a closing rocker 1264, which in turn control opening and closing travel of a sleeve valve 1216. In contrast to the system 400 described above, however, in the system 1200 the opening rocker 1264 and the closing rocker 1260 do not engage an external flange on the sleeve valve 1216. Rather, in the illustrated embodiment the sleeve valve 1216 includes a first aperture 1290*a* and a second aperture 1290*b* formed in opposite sides of a bottom portion of the sleeve valve 1216. In this embodiment, the opening rocker 1264 includes a first arm 1265*a* and a second arm 1265*b* with corresponding sliders 1266 which engage a lower surface of the respective apertures 1290. Similarly, the closing rocker 1260 includes a pair of spaced-apart arms 1267*a, b* which carry sliders 1266 on distal end portions thereof which engage the lower edge of the sleeve valve 1216.

As illustrated in FIG. 12B, the piston 1204 includes side cut-outs 1205 (for example, in the form of a "slipper" piston) adjacent a wrist pin 1207 to provide suitable clearance for the distal end portions of the arms 1265 of the opening rocker 1264. In operation, the opening rocker 1264 drives the sleeve valve 1216 away from the valve seat to open the valve by bearing against lower edge portions of the apertures 1290, while the closing rocker 1260 drives the sleeve valve in the opposite direction to close the valve by bearing against lower edge portions of the sleeve valve 1216. In the foregoing manner, a flange or other feature on the sleeve valve 1216 (such as the flange 444 of FIGS. 4A and 4B) is not required for rocker engagement.

Figure 13B:
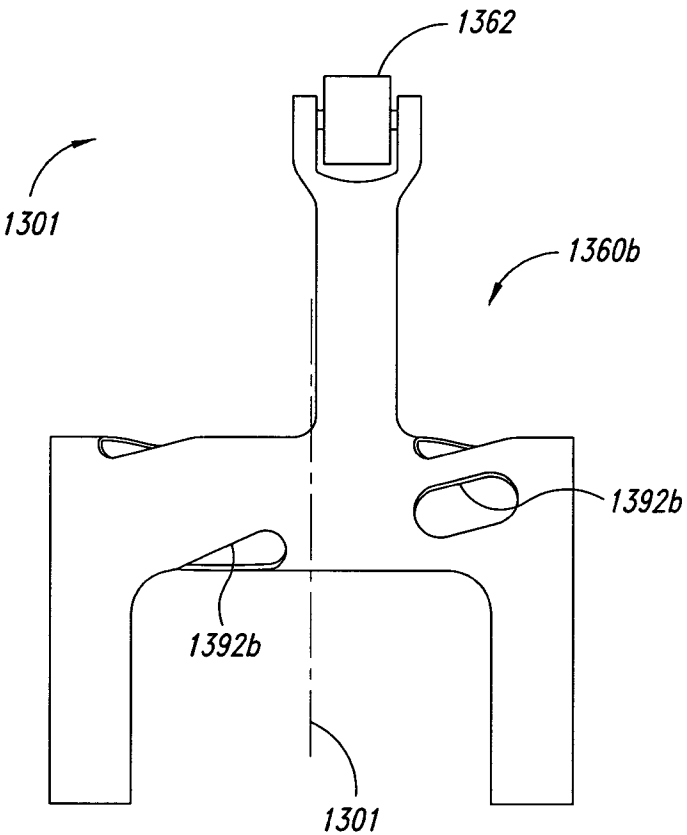
FIGS. 13A and 13B are top views of a sleeve valve rocker having compliance features configured in accordance with an embodiment of the present technology.
Figure 13A:
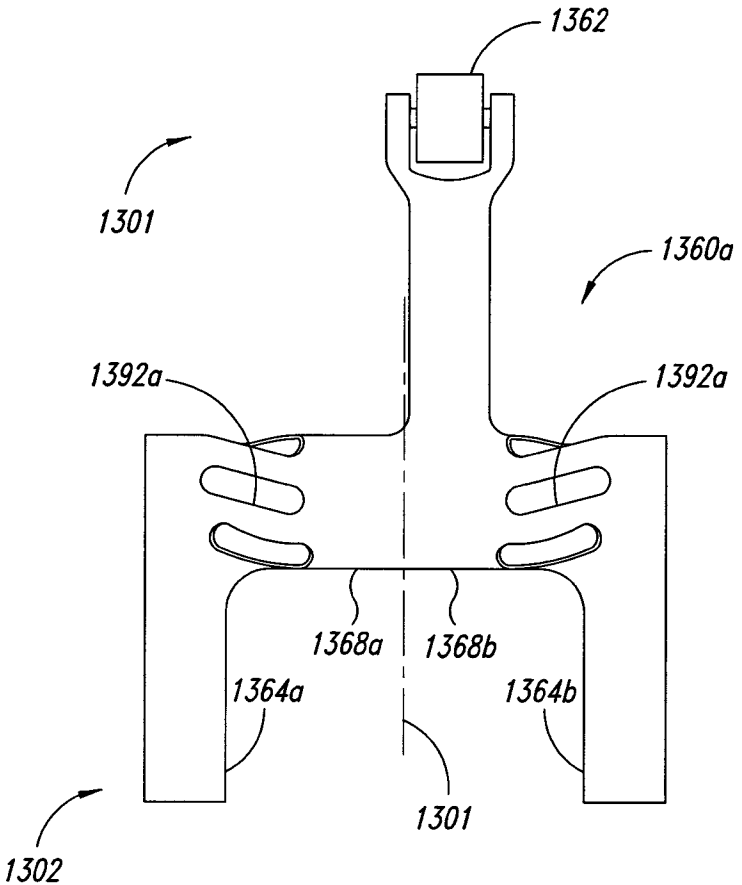

FIGS. 13A and 13B are top views of sleeve valve rockers 1360*a* and 1360*b*, respectively, configured in accordance with embodiments of the present technology. Many features of the rockers 1360*a, b* can be at least generally similar in structure and function to one or more of the rockers (e.g., the rocker 660) described above. For example, each of the rockers 1360 can include a proximal end portion carrying a rotatable cam follower 1362, and a distal end portion 1302 having two spaced apart arms 1364*a, b* configured to extend around opposite sides of a corresponding sleeve valve.

In one aspect of the illustrated embodiment, however, it can be seen that the cam follower 1362 is slightly offset from a centerline 1301 of the rocker arms 1364. As mentioned above with reference to FIG. 4A, the reason for this is because the corresponding cam lobes on the desmodromic camshaft are offset from each other so that both the closing and opening rockers can be accommodated by a single camshaft. This offset, however, can introduce uneven torsional forces in a corresponding base portion 1368 of each rocker arm 1364. In one aspect of the present technology, the torsional stiffness of each of the base portions 1368 can be designed so that each of the two rocker arms 1364 provides the same force on the sleeve valve during engine operation. More specifically, in the embodiment shown in FIG. 13A, the rocker 1360*a* can include one or more elongate recesses or reliefs machined, cast, or otherwise formed in each of the base portions 1368 to provide the two base portions with the same torsional stiffness. In FIG. 13A, the recesses 1392*a* are angled in a first direction to provide differential stiffness in a direction most favorable to the particular rocker application (e.g., whether it is a closing rocker or an opening rocker). As shown in FIG. 13B, however, the recesses 1392 can also be formed in the opposite direction. Moreover, in other embodiments the recesses or grooves 1392 may be oriented in other directions and/or configurations, such as generally straight along the rocker arm base portions 1368 to limit or at least reduce lateral (i.e., side-to-side) motion of the rocker 1360 during operation. In the illustrated embodiment, the arms 1364 can be hollow. In other embodiments, however, the arms 1364 can be solid.

Figure 14A:
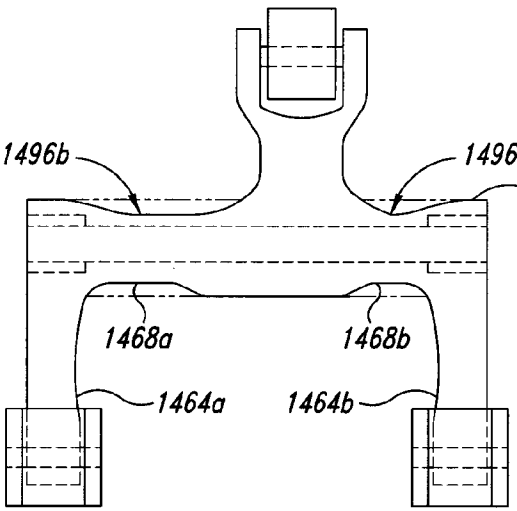
FIGS. 14A and 14B are top and side views, respectively, of another sleeve valve rocker having compliance features configured in accordance with another embodiment of the present technology.
Figure 14B:
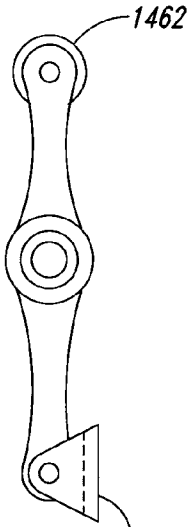

FIGS. 14A and 14B are top and side views, respectively, of a sleeve valve rocker 1460 having torsional features configured in accordance with another embodiment of the present technology. More specifically, these figures illustrate a rocker 1460 having rocker arm base portions 1468*a, b* in which material has been removed from the base portion in the form of circumferential cut-outs or local "necking-down" of the base portion to tailor or tune the torsional stiffness so that each rocker arm 1464 provides the same or at least approximately the same stiffness during engine operation. Matching torsional stiffness of the generally tubular base portions 1468 can provide equal loads on each rocker arm 1464 during engine operation. Moreover, the base portions 1468 can also be designed to provide a desired amount of deflection and "hold-closed" force to seal the corresponding sleeve valve during selected portions of the engine cycle. The arms 1464 can also be designed (e.g., with reduced cross-section) to contribute to the desired deflection under load.

Figure 15A:
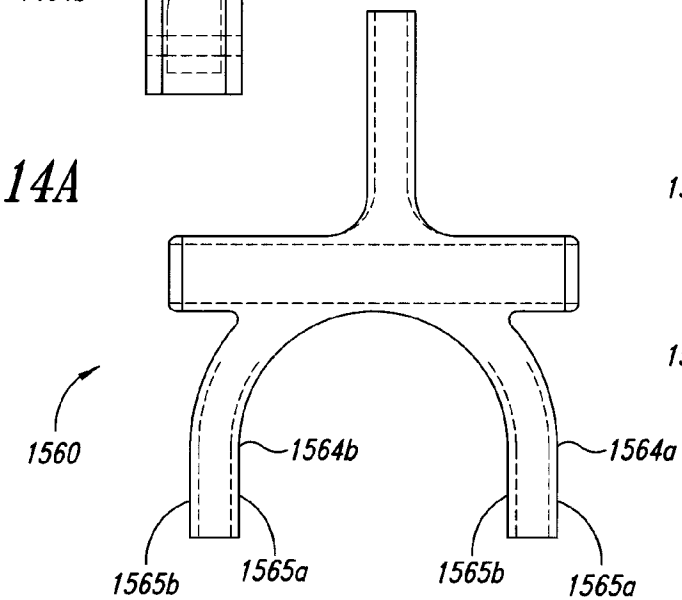
FIGS. 15A and 15B are top and side views, respectively, of yet another sleeve valve rocker having various features configured in accordance with a further embodiment of the present technology.
Figure 15B:
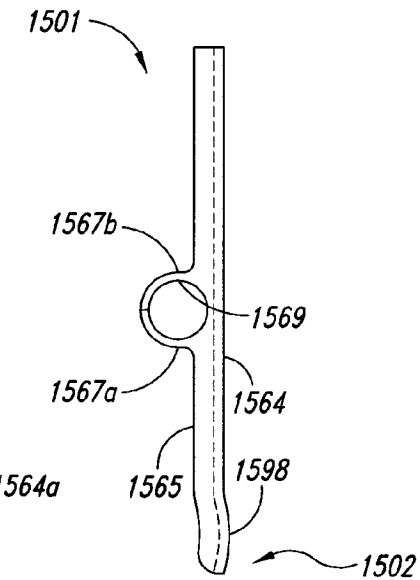

Referring next to FIGS. 15A and 15B, these figures illustrate a sleeve valve rocker 1560 configured in accordance with yet another embodiment of the present technology. More specifically, in the illustrated embodiment the rocker 1560 can be formed from sheet metal (e.g., by stamping) with return flanges 1565*a, b* on rocker arms 1564*a, b* to provide desired stiffness and deflection. In addition, a through hole 1569 for locating the rocker 1560 on its corresponding pivot shaft or spindle can be formed by bending metal tabs or ears 1567*a, b* to form a tubular section around the through hole 1569. A distal end portion 1502 of the rocker arms 1564 can be formed with a slight arc 1598 to provide minimal sliding friction between the distal end portions and an engagement flange or other structure on the corresponding sleeve valve.

In reciprocating sleeve valve engines, the moving mass of the sleeve valves can be significantly greater than, for example, the corresponding mass of poppet valves in conventional internal combustion engines. As a result, such sleeve valve systems can produce greater unbalancing forces than conventional poppet valve systems during engine operation, resulting in greater noise, vibration, and harshness (NVH). By way of example, in one embodiment it is expected that the out-of-balance force required to accelerate and decelerate a sleeve valve may be on the order of 25% of the primary piston force. Accordingly, while valve train inertial forces may be relatively insignificant in conventional poppet valve systems because of their relatively low mass, these forces may warrant closer attention in the design of sleeve valve systems to minimize or at least reduce overall NVH.

Figure 16:
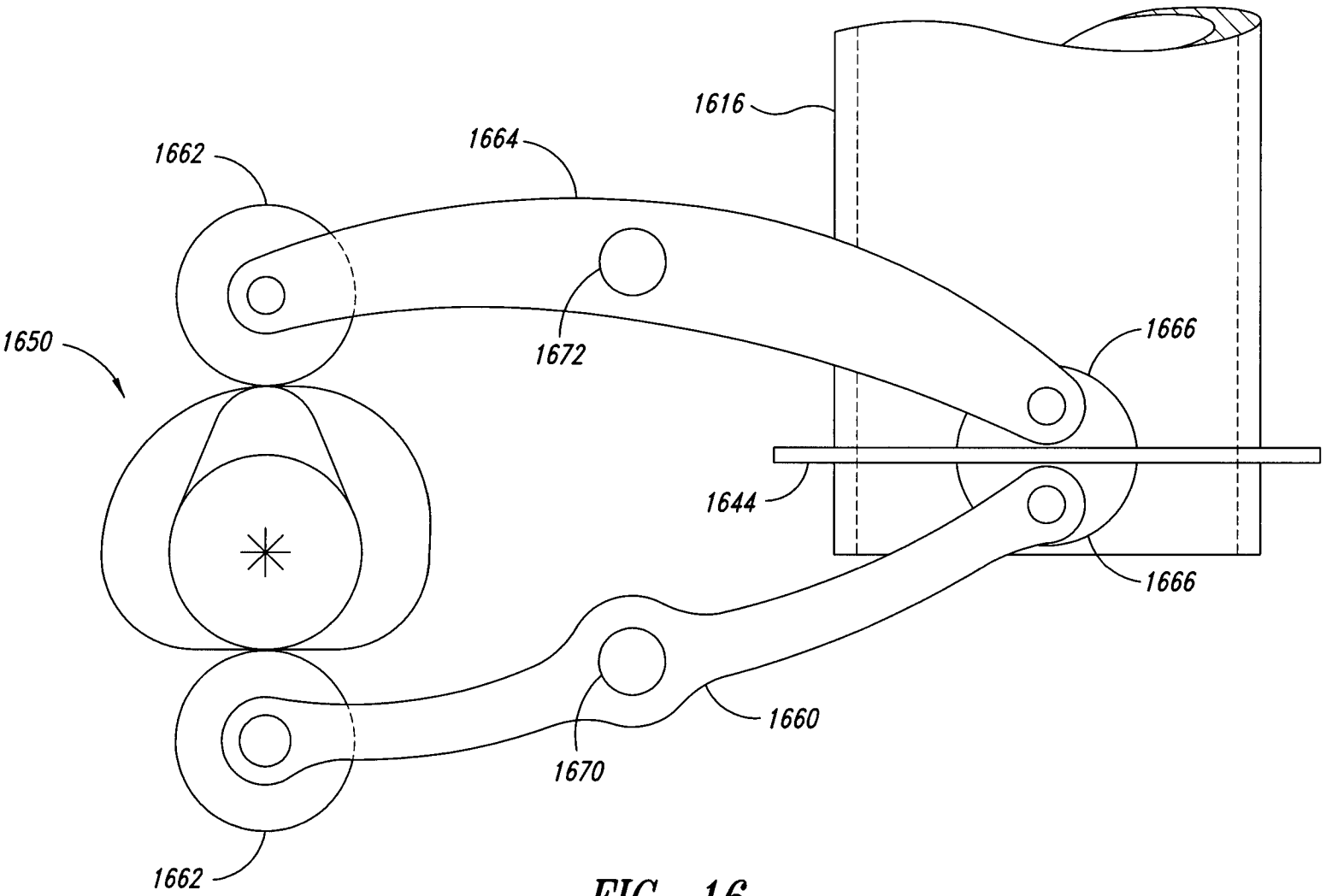
FIG. 16 is a side view of a positive control sleeve valve actuation system having one or more counter-balancing features configured in accordance with an embodiment of the present technology.

FIG. 16 illustrates a desmodromic sleeve valve actuation system in which the active mass of a sleeve valve 1616 is counterbalanced by additional mass added to the opposite ends of a corresponding closing rocker 1660 and an opening rocker 1664. Many features of the rockers 1660 and 1664 can be at least generally similar in structure and function to one or more of the rockers (e.g., the rocker 660) described above. For example, each of the rockers 1660 and 1664 is controlled by a corresponding lobe on a camshaft 1650. In the illustrated embodiment, each of the rockers 1660 and 1664 pivots about a corresponding shaft or spindle 1670 and 1672, respectively. In other embodiments, however, the rockers 1660 and 1664 can pivot about other structures, such as a compliant pivot.

In the illustrated embodiment, the proximal end portions of the rockers 1660 and 1664 carry relatively large cam followers 1662 which have correspondingly larger masses than would otherwise be required. Since the roller cam followers 1662 translate in directions opposite to the sleeve valve 1616, they tend to mitigate the inertial imbalance effect caused by the increased active mass of the sleeve valve 1616. In other embodiments, counterbalancing mass can be added or otherwise operably coupled to the proximal end portions of the rockers 1660 and 1664 using other means, such as by increasing rocker mass in that region, linkages to other reciprocating masses, etc. It is recognized, of course, that while intentionally adding mass to a central-pivot rocker arm, such as those illustrated in FIG. 16, may reduce the net inertial vibrational forces, the rotational inertia of the individual rocker arms about their respective pivots will necessarily increase, and therefore add to the active mass of the overall valve train with corresponding energy losses.

Figure 17B:
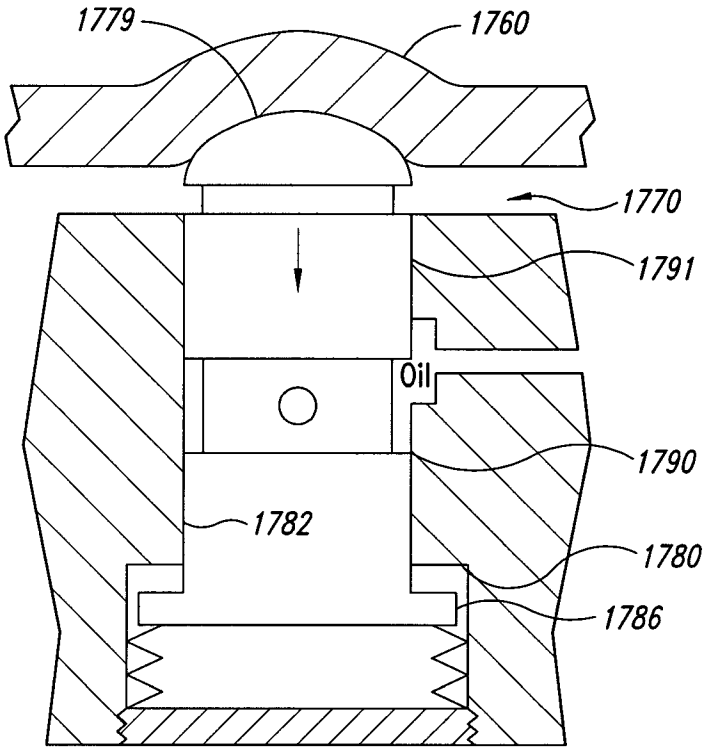
FIGS. 17A and 17B are cross-sectional side views of a compliant rocker pivot having a hydraulic lash control feature configured in accordance with an embodiment of the present technology.
Figure 17A:
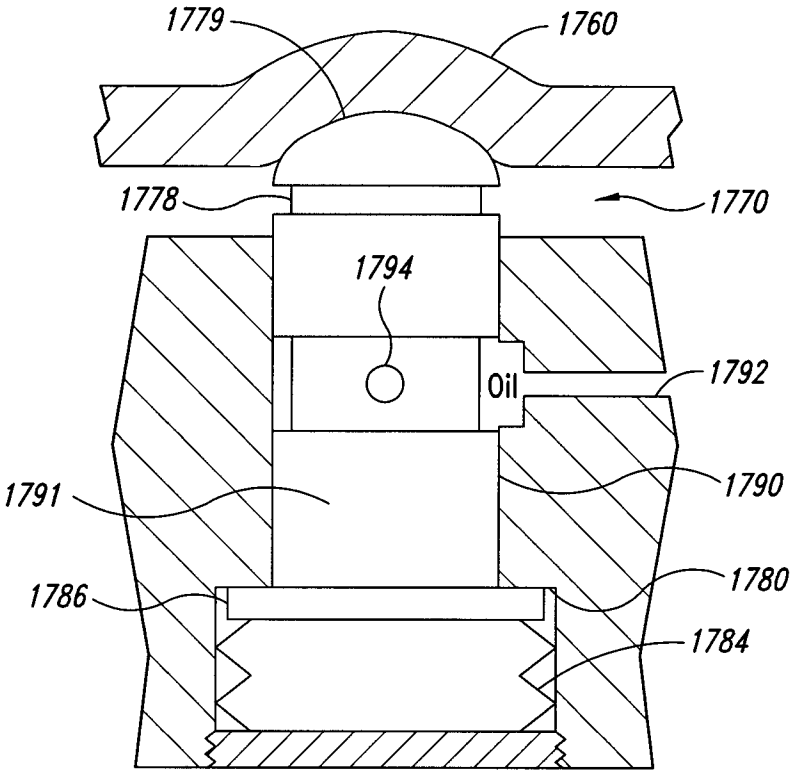

FIGS. 17A and 17B are cross-sectional side views of a compliant pivot assembly 1770 configured in accordance with another embodiment of the present technology. Many components and features of the compliant pivot assembly 1770 are at least generally similar in structure and function to the corresponding components and features of the compliant pivot assembly 870 described above with reference to FIG. 8. For example, in the illustrated embodiment the compliant pivot assembly 1770 includes a pivot member 1778 having a head (e.g., a spherically-shaped head) or crown portion 1779 that is pivotally received in a corresponding recess of a rocker 1760 (e.g., a closing rocker).

In one aspect of this particular embodiment, however, the pivot member 1778 is slidably received in a cylindrical bore of a hydraulic lifter 1790. The hydraulic lifter 1790 includes a lifter body 1791 slidably received in a cylindrical housing bore 1782. The lifter body 1791 includes a flange 1786 that is urged against a stop surface 1780 by a biasing member 1784. The biasing member 1784 can be or can include a coil spring, a stack of Belleville washers, etc.

The hydraulic lifter 1790 can be at least generally similar in structure and function to conventional hydraulic lifters known to those of ordinary skill in the art for use with internal combustion engine valve trains. Accordingly, oil or another suitable hydraulic fluid flows from an oil galley 1792 into the lifter body 1790 via one or more holes 1794. As is known, the relatively high pressure oil flows into a cavity beneath the pivot member 1778, which is biased toward the extended position shown in FIG. 17A via an internal spring (not shown).

The compliant rocker pivot/hydraulic lifter combination described above can be used to reduce or eliminate lash in valve actuation systems during periods of relatively low cam loading in one embodiment as follows. Referring first to FIG. 17A, in this figure the rocker 1760 is contacting the cam lobe (not shown) during a relatively "unloaded" or lightly loaded portion of valve operation (i.e., while the rocker is contacting the base circle of the cam lobe). At this time, oil or other hydraulic fluid (not shown) flows into the lifter body 1791 via the one or more holes 1794 with little resistance and drives the rocker pivot crown 1779 against the rocker 1760 to hold the rocker in light contact with the cam lobe with "zero" lash (i.e., clearance).

Turning next to FIG. 17B, this figure illustrates the compliant pivot assembly 1770 when the rocker 1760 is under a relatively high load (e.g., during the hold-closed portion of the engine cycle when there is interference between the rocker 1760 and the cam lobe, or during an "inertia event" (e.g., when the valve is approaching the fully open position)). The high load causes the rocker 1760 to push downwardly on the pivot member 1778 with a similarly high force. As with conventional valve lifters, however, this force does not drive a significant amount of oil out of the lifter body 1791 because of an internal check valve or similar feature. As a result, the pivot member 1778 does not retract into the lifter body 1791. Instead, as the load on the lifter 1790 increases, the flange 1786 moves away from the stop surface 1780 and compresses the biasing member 1784, thereby causing the pivot member 1778 to deflect and control the total force in the valve actuation system. Accordingly, combining the hydraulic lifter 1790 with the compliant biasing member 1784 can produce a maintenance-free or at least a low-maintenance positive control valve system that can provide pre-determined compliance for sufficient "hold-closed" valve sealing, with little or no lash in the valve actuation system.

If a hydraulic lash adjustment system similar to that described above with reference to FIG. 17A and 17B is also used with the opposing rocker (e.g., an opening rocker) in a desmodromic valve system (such as that described above with reference to FIGS. 4A and 4B), it would be necessary or at least advantageous to provide a stronger mechanical advantage on the closing side compliant pivot assembly than on the opening side to ensure that the valve position is controlled and known when both rockers are running on their respective cam lobe base circles. Otherwise, variable valve positioning could result.

Figure 18:
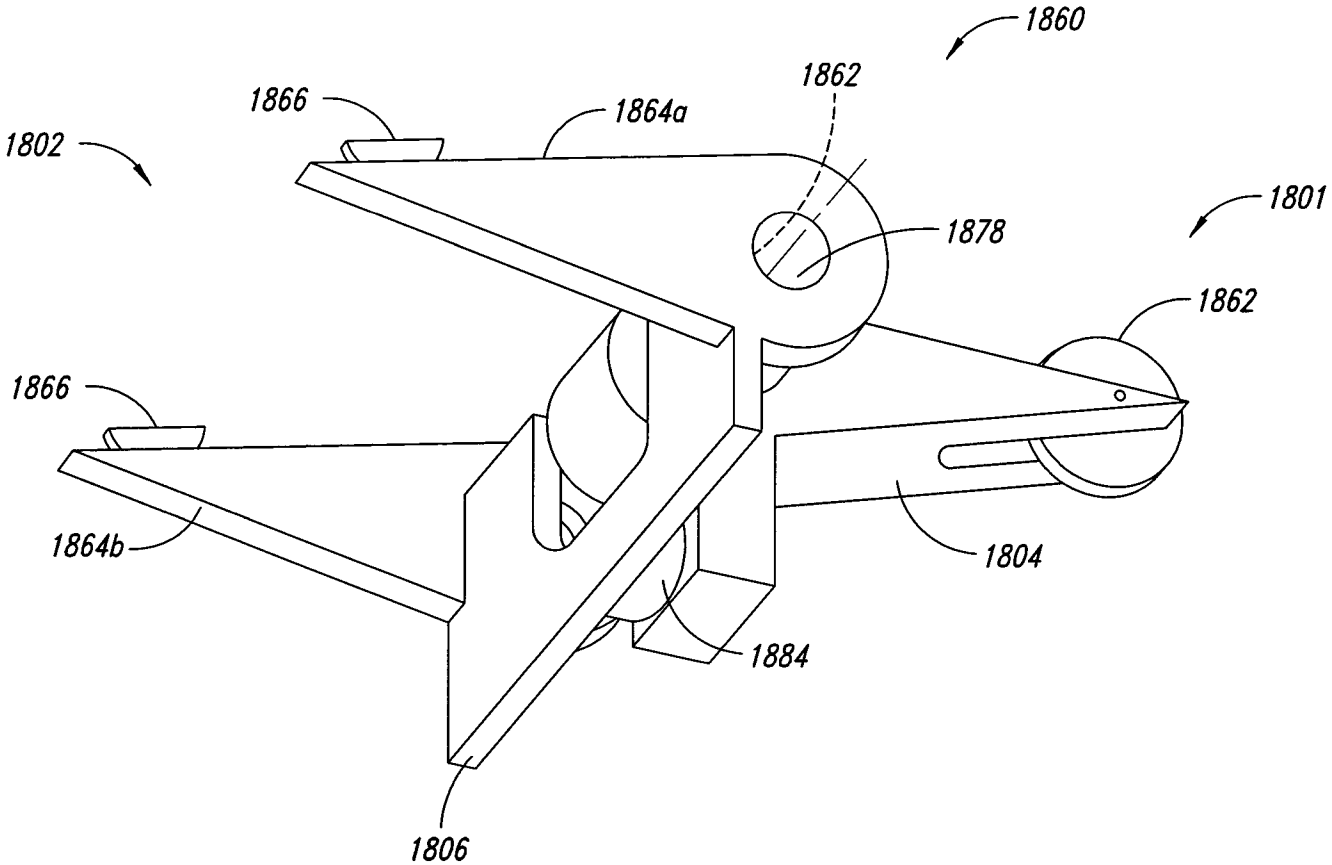
FIGS. 18 is an isometric views of a compliant sleeve valve rocker configured in accordance with yet another embodiment of the present technology.

Various types of valve springs can be incorporated into the compliant rocker/compliant pivot systems described in detail above. In one embodiment, for example, a coil spring, such as the coil spring 244 described above with reference to FIG. 2, can be combined with any of the positive control valve actuation systems described above. Furthermore, in some embodiments the coil spring can be supported on a movable base positioned opposite the corresponding sleeve valve. In this embodiment, the spring controls valve movement during opening and closing motion in a conventional manner. During the hold-closed portion of the engine cycle, however, the spring base is moved toward the valve (by, e.g., a suitable drive screw, cam, hydraulic, pneumatic, or other system) to further compress the spring and provide enhanced valve sealing. This additional compression increases the valve pressure on the seat during the required hold-closed period, yet does not change the "normal" operation of the valve spring during other portions of the engine cycle. Such movable spring base systems can be used as described above in "standard" valve actuation systems, in valve actuation systems such as those described above with reference to FIG. 2, and/or in positive control valve actuation systems, such as one or more of the positive control valve actuation systems described above. It is contemplated that this spring configuration would provide a considerable amount of compliance during the valve actuation cycle with a relatively large tolerance for potential manufacturing tolerances and variations. FIG. 18 is an isometric view of a multi-piece compliant rocker 1860 configured in accordance with a further embodiment of the present technology. Many features of the compliant rocker 1860 can be at least generally similar in structure and function to corresponding features of the rockers described in detail above (e.g., the rocker 660 of FIGS. 6A-6C and/or the rocker 1760 of FIGS. 7A and 7B). In the illustrated embodiment, however, the rocker 1860 includes a first or cam member 1804 positioned toward a proximal end portion 1801, and a corresponding second or valve member 1806 positioned toward a distal end portion 1802. As with the sleeve valve rockers described in detail above, the valve member 1806 includes a pair of opposing arms 1864*a, b* which are fixed together and configured to extend around opposite sides of the corresponding sleeve valve (not shown). Moreover, the distal end portion of each of the arms 1864 can carry a slider 1866 or other suitable feature to interface with a flange or other suitable feature (e.g., a cutout) in or on the sleeve valve for valve actuation. Similarly, the proximal end portion of the cam member 1804 can include a roller cam follower 1862 to reduce friction between the rocker 1860 and the corresponding cam lobe.

In one aspect of the illustrated embodiment, the cam member 1804 is pivotally coupled to the rocker member 1806 by means of a suitable spindle or shaft 1878 operably disposed in a through bore 1862. In addition, the rocker 1860 can further include a compressible member 1884 operably disposed between (e.g., opposing flanges of) the cam member 1804 and the rocker member 1806. The compressible member 1884 can include various types of resilient compressible materials including, for example, coil springs, one or more Belleville washers, high durometer rubber, etc. In operation, the biasing member 1884 enables the arms 1864 to compliantly pivot relative to the rocker member 1804 during cam interference to exert a desired hold-closed force against the corresponding sleeve valve during the engine cycle to facilitate sealing of the sleeve valve as described in detail above.

In other embodiments, multi-piece rockers configured in accordance with the present technology can include more or fewer pieces or parts operably coupled together to provide compliance and other characteristics, such as three or more parts.

The various embodiments and aspects of the invention described above can incorporate or otherwise employ or include the systems, functions, components, methods, concepts and/or other features disclosed in the various references incorporated herein by reference to provide yet further implementations of the invention.

The teachings of the invention provided herein can be applied to other systems, not necessarily the systems described above. The elements and functions of the various examples described above can be combined to provide further implementations of the invention. Some alternative implementations of the invention may include not only additional elements to those implementations noted above, but also may include fewer elements. Further, any specific numbers noted herein are only examples: alternative implementations may employ differing values or ranges.

From the foregoing, it will be appreciated that specific embodiments of the invention have been described herein for purposes of illustration, but that various modifications may be made without deviating from the spirit and scope of the various embodiments of the invention. Further, while various advantages associated with certain embodiments of the invention have been described above in the context of those embodiments, other embodiments may also exhibit such advantages, and not all embodiments need necessarily exhibit such advantages to fall within the scope of the invention. Accordingly, the invention is not limited, except as by the appended claims.

We claim:

1. An internal combustion engine comprising:

a combustion chamber;

a reciprocating sleeve valve having a cylindrical bore and configured to cooperate with a valve seat to open and close a passage in fluid communication with the combustion chamber;

a camshaft operably coupled to the valve and configured to rotate about a central axis;

a cam lobe carried by the camshaft and having an exterior profile at least partially defined by a first surface portion and a second surface portion; and a rocker arm operably disposed between the valve and the cam lobe, wherein the first surface portion is spaced apart from the central axis by a first distance and the second surface portion is spaced apart from the central axis by a second distance, greater than the first distance, wherein the first surface portion positions the valve in contact with the valve seat and presses the valve against the valve seat with at most a first force, and wherein the second surface portion presses the valve against the valve seat with a second force, greater than the first force, during rotation of the camshaft about the central axis.

2. The engine of claim 1 wherein the second surface portion defines a region of maximum lift of the cam lobe.

3. The engine of claim 1 wherein the first surface portion of the cam lobe defines a circular profile, and wherein the second surface portion of the cam lobe defines a raised profile adjacent to the circular profile.

4. The engine of claim 1:

wherein the cam lobe is a valve closing cam lobe;

wherein the camshaft further carries a valve opening cam lobe; and wherein the valve opening cam lobe has an exterior profile at least partially defined by a third surface portion that moves the valve away from the valve seat during rotation of the camshaft.

5. The engine of claim 1, further comprising a piston configured to reciprocate in the cylindrical bore.

6. The engine of claim 1, further comprising:

a piston configured to reciprocate in the bore between a bottom dead center (BDC) position and a top dead center (TDC) position, and wherein the second surface portion of the cam lobe presses the sleeve valve against the valve seat with the second force when the piston is proximate the TDC position.

7. The engine of claim 1, further comprising:

a fulcrum to which the rocker arm is pivotally coupled; and means for reciprocating the fulcrum in response to rotation of the camshaft.

8. The engine of claim 1, further comprising:

a compliant support, wherein the rocker arm is pivotally coupled to the compliant support and depresses the compliant support in response to rotation of the camshaft.

9. The engine of claim 1, further comprising:

a compliant support having a head portion, wherein the rocker arm is pivotally supported by the head portion of the compliant support and depresses the head portion in response to contact with the second surface portion during rotation of the camshaft.

10. The engine of claim 1, further comprising:

a support member slidably disposed in a bore;

a biasing member operably disposed against the support member, wherein the rocker arm is pivotally coupled to the support member such that the rocker arm drives the support member into the bore and compresses the biasing member in response to contact with the second surface portion during rotation of the camshaft.

11. The engine of claim 1, wherein the rocker arm is compliant and is configured to deflect in response to contact with the second surface portion during rotation of the camshaft.

12. The engine of claim 1, wherein the rocker arm is compliant and deflects in response to contact with the second surface portion during rotation of the camshaft, and wherein the rocker arm exerts about 100 newtons of force against the valve per deflection of from about 0.01 mm to about 0.1 mm.

13. A method for operating an internal combustion engine having a reciprocating piston operably disposed in a cylindrical bore of a sleeve valve, wherein the bore of the sleeve valve at least partially defines a combustion chamber, the internal combustion engine further comprising a rocker pivotally disposed between the sleeve valve and a cam lobe, the method comprising:

moving the sleeve valve away from a valve seat to open a passage into the combustion chamber;

while the passage is open, moving the piston toward a bottom dead center (BDC) position in the bore to draw a combustible charge into the combustion chamber;

moving the sleeve valve toward the valve seat;

pressing the sleeve valve against the valve seat with a first force to close the passage into the combustion chamber, the pressing of the sleeve valve against the valve seat with the first force comprising deflecting the rocker a first amount;

while pressing the sleeve valve against the valve seat with the first force, moving the piston toward a top dead center (TDC) position in the bore to compress the combustible charge in the combustion chamber;

as the piston approaches the TDC position, pressing the sleeve valve against the valve seat with a second force, greater than the first force, the pressing of the sleeve valve against the valve seat with the second force comprising deflecting the rocker a second amount which is greater than the first amount; and while pressing the sleeve valve against the valve seat with the second force, igniting the combustible charge to drive the piston toward the BDC position.

14. The method of claim 13 wherein moving the sleeve valve away from the valve seat includes driving the sleeve valve with a first cam lobe, and wherein moving the sleeve valve toward the valve seat includes driving the sleeve valve with a second cam lobe.

15. The method of claim 13 wherein the engine includes a cam lobe operably coupled to the sleeve valve, wherein pressing the sleeve valve against the valve seat with the first force includes driving the sleeve valve against the valve seat with a first surface portion of the cam lobe, and wherein pressing the sleeve valve against the valve seat with the second force includes driving the sleeve valve against the valve seat with a second surface portion of the cam lobe, the second surface portion having greater lift than the first surface portion.

16. The engine of claim 10, further comprising a flange positioned between the biasing member and the support member, the biasing member applying a force against the flange which urges the flange against a part of a housing of the engine until the rocker arm applies a force against the support member that overcomes the force applied by the biasing member.

* * * * *